US008939190B2

(12) United States Patent
Mullet et al.

(10) Patent No.: US 8,939,190 B2
(45) Date of Patent: Jan. 27, 2015

(54) MOTORIZABLE TILT SHADE SYSTEM AND METHOD

(75) Inventors: Willis Jay Mullet, Gulf Breeze, FL (US); Yan Rodriquez, Suwannee, GA (US); Darrin W. Brunk, Pensacola, FL (US); Richard Scott Hand, Pace, FL (US)

(73) Assignee: QMotion Limited, Pensacola, FL (US)

( * ) Notice: Subject to any disclaimer, the term of this patent is extended or adjusted under 35 U.S.C. 154(b) by 439 days.

(21) Appl. No.: 12/931,328

(22) Filed: Jan. 29, 2011

(65) Prior Publication Data

US 2012/0111509 A1 May 10, 2012

Related U.S. Application Data

(63) Continuation-in-part of application No. 12/925,269, filed on Oct. 18, 2010.

(51) Int. Cl.

| | |
|---|---|
| ***E06B 9/32*** | (2006.01) |
| ***E06B 9/322*** | (2006.01) |
| ***E06B 9/307*** | (2006.01) |
| ***E06B 9/308*** | (2006.01) |
| ***E06B 9/323*** | (2006.01) |

(52) U.S. Cl.

CPC ..... *E06B 9/322* (2013.01); *E06B 9/307* (2013.01); *E06B 9/308* (2013.01); *E06B 9/323* (2013.01); *E06B 2009/3222* (2013.01); *E06B 2009/3227* (2013.01); *Y10S 160/17* (2013.01)

USPC ..... 160/176.1 P; 160/DIG. 17

(58) Field of Classification Search

USPC ..... 160/331, 84.04, 84.05, 171, 170, 160/168.1 R, 173 R, 178.1 R, 296, 176.1 P, 160/DIG. 17, 168.1 P

IPC ..... E06B 9/74,2009/3222, 2009/3225, E06B 2009/3227, 9/308, 9/322

See application file for complete search history.

(56) References Cited

U.S. PATENT DOCUMENTS

| | | | | | |
|---|---|---|---|---|---|
| 4,096,903 | A | | 6/1978 | Ringle, III | |
| 4,554,762 | A | | 11/1985 | Anderson | |
| 4,618,804 | A | | 10/1986 | Iwasaki | |
| 4,706,726 | A | | 11/1987 | Nortoft | |
| 5,038,087 | A | * | 8/1991 | Archer et al. | 318/469 |
| 5,070,927 | A | * | 12/1991 | Chen | 160/344 |
| 5,207,261 | A | | 5/1993 | Quezel | |
| 5,391,967 | A | * | 2/1995 | Domel et al. | 318/400.08 |
| 5,413,161 | A | | 5/1995 | Corazzini | |
| 5,444,339 | A | * | 8/1995 | Domel et al. | 318/17 |
| 5,495,153 | A | * | 2/1996 | Domel et al. | 318/17 |
| 5,517,094 | A | * | 5/1996 | Domel et al. | 318/400.08 |
| 5,531,257 | A | | 7/1996 | Kuhar | |
| 5,698,958 | A | * | 12/1997 | Domel et al. | 318/480 |
| 5,714,855 | A | * | 2/1998 | Domel et al. | 318/280 |
| 5,729,103 | A | * | 3/1998 | Domel et al. | 318/283 |
| 5,760,558 | A | * | 6/1998 | Popat | 318/480 |

(Continued)

*Primary Examiner* — David Purol

(74) *Attorney, Agent, or Firm* — Zarley Law Firm, P.L.C.

(57) ABSTRACT

A motorizable tilt shade system includes a header system where the header system includes an integral header attachment connection. At least one cord spool is provided within the header system and is connected with at least one suspension cord. A shade is suspended from the at least one suspension cord and a tilt cord pulley is connected with the at least one cord spool. A tilt cord is connected with the tilt cord pulley and with the shade such that the tilt cord and tilt cord pulley cooperate to tilt the shade. A drive shaft receiver is connected with the tilt cord pulley such that movement of the drive shaft receiver moves the tilt cord pulley.

20 Claims, 14 Drawing Sheets

(56) References Cited

U.S. PATENT DOCUMENTS

| | | | | |
|---|---|---|---|---|
| 5,793,174 | A * | 8/1998 | Kovach et al. | 318/468 |
| 5,883,480 | A * | 3/1999 | Domel et al. | 318/282 |
| 5,907,227 | A * | 5/1999 | Domel et al. | 318/480 |
| 5,990,646 | A * | 11/1999 | Kovach et al. | 318/468 |
| 6,003,584 | A * | 12/1999 | Weinreich | 160/191 |
| 6,060,852 | A * | 5/2000 | Domel et al. | 318/480 |
| 6,062,290 | A * | 5/2000 | Domel | 160/176.1 V |
| 6,116,320 | A * | 9/2000 | Peterson | 160/84.02 |
| 6,116,323 | A * | 9/2000 | Huang | 160/170 |
| 6,148,894 | A * | 11/2000 | Judkins | 160/177 R |
| 6,259,218 | B1 * | 7/2001 | Kovach et al. | 318/16 |
| 6,283,190 | B1 * | 9/2001 | Hu et al. | 160/84.02 |
| 6,338,377 | B1 * | 1/2002 | Domel | 160/84.02 |
| 6,369,530 | B2 * | 4/2002 | Kovach et al. | 318/16 |
| 6,371,192 | B1 * | 4/2002 | Anderson et al. | 160/178.1 R |
| 6,382,294 | B1 * | 5/2002 | Anderson et al. | 160/168.1 P |
| 6,433,498 | B1 * | 8/2002 | Domel et al. | 318/280 |
| 6,446,693 | B1 | 9/2002 | Anderson et al. | |
| 6,516,858 | B1 * | 2/2003 | Anderson et al. | 160/168.1 P |
| 6,533,018 | B2 * | 3/2003 | Anderson et al. | 160/178.1 R |
| 6,536,503 | B1 | 3/2003 | Anderson et al. | |
| 6,708,750 | B2 * | 3/2004 | Collett et al. | 160/84.02 |
| 6,736,186 | B2 * | 5/2004 | Anderson et al. | 160/168.1 P |
| 6,795,226 | B2 | 9/2004 | Agrawal et al. | |
| 6,850,017 | B1 * | 2/2005 | Domel et al. | 318/400.29 |
| 6,867,565 | B2 | 3/2005 | Maistre et al. | |
| 6,957,683 | B2 | 10/2005 | Toti | |
| 7,129,657 | B2 * | 10/2006 | Cavarec et al. | 318/280 |
| 7,147,029 | B2 * | 12/2006 | Kovach et al. | 160/121.1 |
| 7,389,806 | B2 | 6/2008 | Kates | |
| 7,832,453 | B2 | 11/2010 | Lin | |
| 7,857,030 | B2 * | 12/2010 | Cheng | 160/168.1 P |
| 2002/0027184 | A1 * | 3/2002 | Kovach et al. | 248/262 |
| 2002/0088561 | A1 * | 7/2002 | Anderson et al. | 160/168.1 R |
| 2003/0145956 | A1 * | 8/2003 | Domel et al. | 160/168.1 R |
| 2003/0145957 | A1 * | 8/2003 | Domel et al. | 160/168.1 R |
| 2003/0145958 | A1 * | 8/2003 | Domel et al. | 160/168.1 R |
| 2008/0128097 | A1 * | 6/2008 | Yu et al. | 160/170 |
| 2008/0230189 | A1 * | 9/2008 | Rossato et al. | 160/115 |
| 2010/0269988 | A1 * | 10/2010 | Mullet et al. | 160/310 |
| 2012/0031567 | A1 * | 2/2012 | Shier et al. | 160/1 |
| 2012/0031571 | A1 * | 2/2012 | Mullet et al. | 160/310 |
| 2012/0090797 | A1 * | 4/2012 | Mullet et al. | 160/331 |
| 2012/0111509 | A1 * | 5/2012 | Mullet et al. | 160/331 |

* cited by examiner

MOTORIZABLE TILT SHADE SYSTEM AND METHOD

CROSS REFERENCE TO RELATED APPLICATION

This application is a Continuation in Part of U.S. patent application Ser. No. 12/925,269 filed Oct. 18, 2010 entitled "Motorizable Shade System and Method". The Applicants hereby claim the benefit of the non-provisional application under 35 U.S.C. §120. The entire content of the non-provisional application is incorporated herein by this reference.

FIELD OF THE INVENTION

This invention relates to a motorizable tilt shade system and method. In particular, in accordance with one embodiment, the invention relates to a motorizable tilt shade system including a header system where the header system includes an integral header attachment connection. At least one cord spool is provided within the header system and is connected with at least one suspension cord. A shade is suspended from the at least one suspension cord and a tilt cord pulley is connected with the at least one cord spool. A tilt cord is connected with the tilt cord pulley and with the shade such that the tilt cord and tilt cord pulley cooperate to tilt the shade. A drive shaft receiver is connected with the tilt cord pulley such that movement of the drive shaft receiver moves the tilt cord pulley.

BACKGROUND OF THE INVENTION

A problem exists in the field of shade devices. The term "shade devices" includes all forms of devices used to provide covering or shade such as window and door shades for example only. While the art is replete with manual shades, meaning shades that must be operated by hand, and mechanical shades, meaning shades that are operated by machines such as motors, prior to Applicants' prior pending application for a motorizable shade system referenced above, there were no shades that are manual that are conformed to be converted to mechanical if and when the user desires. This is to say, certainly a person can convert a manual shade to a mechanical shade by adding a motor and wiring the operable parts and power connections, etc. together, but this is a task way beyond the skill set of the ordinary user. Further, the resulting device can never look the same as a result of the addition of these elements most of which will of necessity be located on the outside, visible, exterior of the old manual shade.

There are several reasons why a person may wish to convert a manual shade to a mechanical shade. One reason is, of course, ease of operation. Another reason may be that the user is concerned about the potential hazard represented by the presence of the manual "operational cord". The term "operational cord" as used herein is defined to mean the cord the user manipulates to cause the shade to lower or raise. Operational cords often are found in a continuous loop and the loop has been indicated in several serious accidents involving children and pets getting entangled with the loop.

There have been several solutions to eliminating the manual operational cords from blinds and shades because of the fact that operational cords pose a danger to children and pets and are simply not aesthetically pleasing. Applicants are aware, for example, that there are add-on battery powered actuators that operate the manual operating cords to raise and lower the shade but they do not eliminate the ugly cords or the danger posed by the cords. Further, these add on systems require installation of connecting wires, screws and bolts, which take up limited space and are difficult to conceal and pose potential interference problems with existing cords and strings and other internal moving parts.

Applicants are also aware that shade systems exist that are counterbalanced such that the shade can be moved to a desired position by pulling or pushing the covering and it will stay in the selected position. These systems are called "cordless" systems, meaning systems without operational cords. Further, there are shade systems which are suspended by flexible elements such as suspension cords or strings that are connected with the shade and are used to raise and lower the shade. These systems are called "corded" shade systems meaning shade systems in which the shade is suspended from a suspension cord. Corded shade systems may or may not include operational cords.

Notwithstanding the vast improvement in the art represented by Applicants' prior pending application for a motorizable shade system, there still exists a problem in the art with regard to "tilt" shades. "Tilt shades" as used herein refers to shades with individual shade elements such a slats in a "Venetian" blind, for example only and not by way of limitation. Mini-blinds and even some cellular shades also often are adjustable so as to move the individual shade elements. While these tilt shades come with operational cords, they also require a separate tilt cord in order to provide adjustment of the individual slats.

The prior listed limitations of operational cords applies to the tilt cords of these tilt shades as well. They create a more complicated shade system and one that is either manual or mechanical but none exist that are either manual or mechanical at the user's whim and easily converted from one to the other and back again as often as the user desires.

Applicants have reviewed the prior art and have found the following art to be representative. U.S. Pat. No. 4,096,903 to Ringle III, discloses an upper channular frame supporting a Venetian blind that houses a rotary shaft parallel to the slats of the blind and from which the slats are suspended by a pair of nylon ladders. The shaft is driven by a small D.C. motor and gear reduction unit having an output governed by limit switches selectively operable to provide a predetermined limit of angular slat movement. The limit switches are incorporated in parallel branches directly in one of the power lines to the motor, with individual diodes controlling the direction of the current through the corresponding branches.

U.S. Pat. No. 4,554,762 to Anderson, discloses a sun blind for motor vehicles including a plurality of horizontally extending slats (2) supported by "ladder" assemblies (4) including rigid side pieces (6) and cross-pieces supporting and locating the slats. An electric motor (10) is connected between the ladder assemblies and a fixed mounting point in such a way that rotation of the motor causes the angle of the slats to be varied. An automatic control, circuit opens the blind whenever the ignition of the vehicle is switched on and closes it at a predetermined time after the ignition is switched off.

U.S. Pat. No. 4,618,804 to Iwasaki, discloses a remote control system for bidirectionally rotating an electric motor, such as for opening and closing a blind or the like, comprises a hand-held transmitter including a transmitting circuit capable of developing a forward rotation command signal and a reverse rotation command signal, and a transmitter responsive to each of the command signals for producing a corresponding, predetermined number of infrared pulses for a predetermined amount of time. A receiver and drive unit is operatively coupled with the motor and comprises a receiver responsive to the infrared pulses for developing a corresponding received command signal, a discriminator circuit for determining whether the received command signal corresponds to the command signal for normal rotation or reverse rotation and for producing a corresponding forward rotation or reverse rotation control signal, and a drive circuit responsive to the control signal for causing rotation of the electric motor in the corresponding direction.

U.S. Pat. No. 4,706,726 to Nortoft, discloses a device for the purpose of giving the user of an electric control of a Venetian blind in a window the possibility of adjusting the angular position of the slats independently of raising or lowering the Venetian blind by utilizing an electric motor, spring clutches, and corresponding lift cords, the electric control includes a control circuit with a three position switch controlled by the user. The control circuit is arranged so as to drive the motor at a low speed during a first predetermined time interval for adjusting the angle of the slats and thereafter to drive the motor at an increased speed for raising or lowering the Venetian blind.

U.S. Pat. No. 5,207,261 to Quezel Castraz discloses a Venetian blind system that includes a winding drum (5), on which is wound a cord (8) fastened to the lowermost slat (10) of the blind and a mechanism for orienting the slats of the blin, including a flexible ladder which is driven frictionally and the bands (15, 16) of which are fastened to the slats of the blind for their orientation. The orientation device includes a slide (17) mounted elastically and displaced transversely by the cord (8) when a pulling force is exerted on the cord. The slide controls the passage of stop pieces (27, 28) fixed to the ladders and consequently the orientation of the slats of the blind.

U.S. Pat. No. 5,391,967 to Domel, et al. discloses a mini-blind actuator that has a motor and a housing that holds the motor and a dc battery. The rotor of the motor is coupled to the baton of the mini-blind for rotating the baton and thereby opening or closing the slats of the mini-blind. Alternatively, the rotor is coupled to the tilt rod of the blind to rotate the tilt rod and thereby open or close the slats of the mini-blind. A control signal generator generates a control signal for completing the electrical circuit between the battery and the motor. The control signal can be generated in response to a predetermined amount of daylight or in response to a user-generated remote command signal.

U.S. Pat. No. 5,413,161 to Corazzini, discloses a solar powered window shade which consists of a Venetian blind mounted within an interior of a frame of a window in a wall of a building. An apparatus is carried by the Venetian blind, for converting solar radiation of sunlight into electrical energy. A mechanism is carried by the Venetian blind for utilizing the electrical energy to open and close the Venetian blind. At sunrise and all through the day, the Venetian blind will remain opened to allow sunlight to enter through the window, to help heat up the building. At sunset and all through the night, the Venetian blind will remain closed to produce a thermal barrier, to help retain the heat within the building.

U.S. Pat. No. 5,531,257 to Kuhar discloses a cordless, balanced Venetian blind or shade with a constant, or a variable force spring motor that includes conventional window covering components without the outside hanging lifting cords or cord locking mechanisms. One or more spring motors are employed. A cord spool, in the preferred embodiment, is coupled to one of the spring drums to serve to wind the cords to cause the blind to be raised or lowered, simply by manipulation of the bottom bar of the blind system. Due to the spring forces, the system compensates for the increasing weight on the cords as the window covering is raised and for the decreasing weight as it is lowered.

U.S. Pat. No. 5,698,958 to Domel, et al. discloses a mini-blind actuator that has a motor and a housing that holds the motor and a dc battery. The rotor of the motor is coupled to the baton of the mini-blind for rotating the baton and thereby opening or closing the slats of the mini-blind. Alternatively, the rotor is coupled to the tilt rod of the blind to rotate the tilt rod and thereby open or close the slats of the mini-blind. A control signal generator generates a control signal for completing the electrical circuit between the battery and the motor. The control signal can be generated in response to a predetermined amount of daylight or in response to a user-generated remote command signal. The actuator can be used to rotate the slats of horizontal or vertical blinds, or the sections of a pleated shade. Or, the actuator can be used to rotate the hollow rotatable tube of a roll-up shade.

U.S. Pat. No. 5,760,558 to Popat discloses a system for automatic operation of Venetian blinds and similar window coverings. A preferred embodiment, system 30, can be retrofitted to any conventional Venetian blind without tools, removal of the blind, or installation of wiring (FIG. 10A). System 30 is attached to a blind 15 by a bracket 80, which engages a headrail 16 of blind 15, and is secured by a thumbscrew 84 (FIG. 4C). System 30 includes a gear motor 85 which drives a coupling tube 91; coupling tube 91 is attached to a tilt-adjustment shaft 18 of blind 15 (FIG. 3A). The mechanical coupling between gear motor 85 and coupling tube 91 includes a flexible coupling and an extensible coupling, which enable gear motor 85 to rotate shaft 18 over a wide range of sizes and configurations of blind 15 (FIGS. 5A and 5B). System 30 also includes a photovoltaic source 31 mounted on a flexible member 99. Member 99 provides electrical connections to source 31, and supports it in an advantageous position to receive solar radiation (FIGS. 8B and 8C), regardless of the size and mounting arrangement of blind 15. System 30 also includes four momentary-contact electrical switches 38 to 41 and an actuating body 94, to which a tilt-control wand 19 of blind 15 can be attached. Together, actuating body 94 and switches 38 to 41 enable system 30 to be conveniently controlled by rotary and axial movements of wand 19 (FIG. 10A).

U.S. Pat. No. 5,793,174 to Kovach, et al., discloses a wireless battery-operated window covering assembly. The window covering has a head rail in which all the components are housed. These include a battery pack, an interface module including an IR receiver and a manual switch, a processor board including control circuitry, motor, drive gear and a rotatably mounted reel on which lift cords wind and unwind a collapsible shade. The circuitry allows for dual-mode IR receiver operation and a multi-sensor polling scheme, both of which are configured to prolong battery life. Included among these sensors is a lift cord detector which gauges shade status to control the raising and lowering of the shade and a rotation sensor which, in conjunction with internal registers and counters keeps track of travel limits and shade position.

U.S. Pat. No. 5,990,646 to Kovach, et al., discloses a wireless battery-operated window covering assembly. The window covering has a head rail in which all the components are housed. These include a battery pack, an interface module including an IR receiver and a manual switch, a processor board including control circuitry, motor, drive gear and a rotatably mounted reel on which lift cords wind and unwind a collapsible shade. The circuitry allows for dual-mode IR receiver operation and a multi-sensor polling scheme, both of which are configured to prolong battery life. Included among these sensors is a lift cord detector which gauges shade status to control the raising and lowering of the shade and a rotation sensor which, in conjunction with internal registers and counters keeps track of travel limits and shade position.

U.S. Pat. No. 6,259,218 to Kovach, et al. discloses a wireless battery-operated window covering assembly. The window covering has a head rail in which all the components are housed. These include a battery pack, an interface module including an IR receiver and a manual switch, a processor board including control circuitry, motor, drive gear and a rotatably mounted reel on which lift cords wind and unwind a collapsible shade. The circuitry allows for dual-mode IR receiver operation and a multi-sensor polling scheme, both of which are configured to prolong battery life. Included among these sensors is a lift cord detector which gauges shade status to control the raising and lowering of the shade and a rotation sensor which, in conjunction with internal registers and counters keeps track of travel limits and shade position.

U.S. Pat. No. 6,446,693 to Anderson et al. discloses a headrail designed for powered coverings for architectural openings comprising a housing defining an interior that conveniently hides a battery holder, a signal-receiving system, and an electric motor used to adjust the configuration of the covering. The headrail also hides improved hardware for mounting the motor and, in the case of coverings comprising tiltable elements, improved hardware for mounting a tilt rod. Additionally, in the case of coverings comprising tiltable elements, the headrail hides improved hardware for adjustably attaching the tiltable elements to the tilt rod in a manner that prevents over-rotation of the tiltable elements. The battery holder may comprise a battery magazine or a battery carrier removably mounted in the headrail housing. The batteries may be inserted into or extracted from the battery holder through an opening in a bottom wall of the headrail housing. A swingably mounted trap door may selectively cover or uncover the opening. The battery carrier slidingly engages, through the opening in the bottom of the headrail housing, a battery carrier housing that is mounted within the headrail housing. The signal-receiving system includes an exposed signal receiver for receipt of remote-control signals. The present invention also provides a tilt control system with an inexpensive and effective clutch to prevent over-winding of cords onto a control shaft (e.g., a tilt rod) used to control tiltable elements of the covering. The preferred tilt control system also minimizes torque on the motor or other mechanism used to drive the control shaft.

U.S. Pat. No. 6,516,858 to Anderson et al. discloses a headrail including a detachable battery holder for powered coverings for architectural openings. The headrail comprises a housing defining an interior into which a battery magazine is removably mounted. In this manner, the batteries are hidden within the headrail for a more aesthetically pleasing look than can be achieved when the batteries are mounted outside of the headrail. The housing may include one or more small slots into which corresponding tabs on end caps mounted on the ends of the battery magazine may be inserted. The housing may also include a larger opening through which batteries may be inserted into or extracted from the battery magazine while it is mounted in the housing. Further, the housing may include one or more elongated openings for cooling, or through which installed batteries may be inspected, or into which tools may be inserted to move the batteries that are installed in the battery magazine.

U.S. Pat. No. 6,536,503 to Anderson et al. discloses a modular blind transport system for a window blind application. The complete system may be assembled from a relatively small number of individual modules to obtain working systems for a very wide range of applications, including especially a category of counterbalanced blinds wherein a relatively small external input force may be used to raise or lower the blind, and/or to open or close the blind. The primary objective of this invention is to provide a modular blind transport system which overcomes the shortcomings of prior blind transport systems. Rather than having to design a completely new system for each size and weight of blind, the designs of the present invention provide a system comprised of individual modules which are readily interconnected to satisfy the requirements of a multitude of different blind systems, it also includes the individual modules which make the overall system possible.

U.S. Pat. No. 6,655,441 to Wen et al. discloses a friction transmission mechanism for a motor-driven blind that is constructed to include a driving unit, and at least one cord roll-up unit controlled to the driving unit to lift/lower or tilt the slats of the motor-driven Venetian blind. Each cord roll-up unit includes an amplitude modulation wheel controlled by the driving unit to lift/lower the slats and bottom rail of the Venetian blind, a frequency modulation wheel for rotation with the amplitude modulation set to tilt the slats of the Venetian blind, spring elements, which forces the frequency modulation wheel into friction-engagement with the amplitude modulation wheel, and a support supporting the amplitude modulation wheel, the support having a shoulder adapted to act with a protruding block of the frequency modulation wheel and to further limit angle of rotation of the frequency modulation wheel.

U.S. Pat. No. 6,736,186 to Anderson et al. discloses a headrail designed for powered coverings for architectural openings comprises a housing defining an interior that conveniently hides a battery holder, a signal-receiving system, and an electric motor used to adjust the configuration of the covering. The headrail also hides improved hardware for mounting the motor and, in the case of coverings comprising tiltable elements, improved hardware for mounting a tilt rod. Additionally, in the case of coverings comprising tiltable elements, the headrail hides improved hardware for adjustably attaching the tiltable elements to the tilt rod in a manner that prevents over-rotation of the tiltable elements. The battery holder may comprise a battery magazine or a battery carrier removably mounted in the headrail housing. The batteries may be inserted into or extracted from the battery holder through an opening in a bottom wall of the headrail housing. A swingably mounted trap door may selectively cover or uncover the opening. The battery carrier slidingly engages, through the opening in the bottom of the headrail housing, a battery carrier housing that is mounted within the headrail housing. The signal-receiving system includes an exposed signal receiver for receipt of remote-control signals. The present invention also provides a tilt control system with an inexpensive and effective clutch to prevent over-winding of cords onto a control shaft (e.g., a tilt rod) used to control tiltable elements of the covering. The preferred tilt control system also minimizes torque on the motor or other mechanism used to drive the control shaft.

U.S. Pat. No. 6,795,226 to Agrawal, et al. discloses a transparent chromomeric assembly in which color changes are selectively effectible over predefined areas comprises a pair of facing transparent substrates (15, 21, 28) each covered with a conductive layer divided into individual energizeable areas each provided with a set of bus bars (187, 188). A passive layer may be superimposed over one of the substrates, its color being chosen so that the color and the transmissivity of the passive layer accommodates the range of color change and transmissivity of the electrochromic layer to maintain the transmitted color of the panel in a warm or neutral shade. Various other chromomeric windows, devices and systems are also disclosed.

U.S. Pat. No. 6,850,017 to Domel et al. discloses a mini-blind actuator that has a motor and a housing that holds the motor and a dc battery. The rotor of the motor is coupled to the baton of the mini-blind for rotating the baton and thereby opening or closing the slats of the mini-blind. Alternatively, the rotor is coupled to the tilt rod of the blind to rotate the tilt rod and thereby open or close the slats of the mini-blind. A control signal generator generates a control signal for completing the electrical circuit between the battery and the motor. The control signal can be generated in response to a predetermined amount of daylight or in response to a user-generated remote command signal. The actuator can be used to rotate the slats of horizontal or vertical blinds, or the sections of a pleated shade. Or, the actuator can be used to rotate the hollow rotatable tube of a roll-up shade.

U.S. Pat. No. 6,867,565 to Maistre, et al. discloses a process that contains the following steps: entering a teaching mode, defining and recording zero, one or two limit of travel positions, exiting the teaching mode, determining the number and the type of the limits of travel produced by end stops, if there exists at least one limit of travel produced by virtue of an end stop, detecting and recording the position of the end stops.

U.S. Pat. No. 6,957,683 to Toti discloses a spring drive system useful for window covers which comprises one or more coil spring drives or flat spring drives and the combination whose elements are selected from one or more of a group which includes (1) a band or cord transmission which provides varying ratio power transfer as the cover is opened and closed; (2) gear means comprising various gear sets which provide frictional holding force and fixed power transfer ratios; (3) a gear transmission which provides fixed ratio power transfer as the cover is opened or closed; (4) crank mechanisms; (5) brake mechanisms; and (6) recoiler mechanisms. The combination permits the spring drive force to be tailored to the weight and/or compression characteristics of an associated window cover such as a horizontal slat or pleated or box blind as the cover is opened and closed.

U.S. Pat. No. 7,389,806 to Kates discloses an electronically-controlled roll-up window shade that can easily be installed by a homeowner or general handyman. The motorized shade includes an internal power source, a motor, and a communication system to allow for remote control of the motorized shade. One or more motorized shades can be controlled singly or as a group. In one embodiment, the motorized shades are used in connection with a zoned or non-zoned HVAC system to reduce energy usage. In one embodiment, the motorized shade is configured to have a size and form-factor that conforms to a standard manually-controlled motorized shade. In one embodiment, a group controller is configured to provide thermostat information to the motorized shade. In one embodiment, the group controller communicates with a central monitoring system that coordinates operation of one or more motorized shades. In one embodiment, the internal power source of the motorized shade is recharged by a solar cell.

In all of the references of which Applicants are aware, motorized shades are complex systems very different from manual systems and, thus, the user at the time of purchase must decide then whether the situation calls for a manual or a motorized system. Further, not all products from a particular company include both manual and motorized options. Thus, a user may need to choose a motorized system from one manufacturer and a manual system from another if they want both types of units. Then, of course, many times the products from different manufacturers do not match in appearance.

Applicants have found that a need in the art exists for a manual shade that is "motorizable". As used herein, the term "motorizable" refers to a system that operates as a manual shade but is conformed such that the manual system includes elements required so that it is easily converted to a mechanical, motorized, system. Further, there is a need in the art for manual shade systems which include operational cords to be able to eliminate the operational cords and to convert the system to a mechanical, motorized system. In particular, there is a need in the art for a motorizable shade system that enables motorization of tilt shades and that eliminates the need for two separate cords, an operational cord to raise and lower the blind and a tilt cord to tilt the shade.

It, therefore, is an object of this invention to provide a shade system that can be purchased and installed as a manually operated system but that is quickly and easily converted to a motorized system by an ordinary consumer without need for special tools and equipment. It is a further object of the invention to provide a manual shade system with or without operational cords that is motorizable. It is a still further object of the invention to provide a motorizable shade that is also quickly and easily converted from a motorized shade to a manual shade. And it is a further object of the invention to provide a shade system that eliminates the need for two separate cords to raise and lower and to tilt the shade.

SUMMARY OF THE INVENTION

Accordingly, the motorizable tilt shade system of the present invention, according to one embodiment includes a header system where the header system includes an integral header attachment connection. At least one cord spool is provided within the header system and is connected with at least one suspension cord. A shade is suspended from the at least one suspension cord and a tilt cord pulley is connected with the at least one cord spool. A tilt cord is connected with the tilt cord pulley and with the shade such that the tilt cord and tilt cord pulley cooperate to tilt the shade. A drive shaft receiver is connected with the tilt cord pulley such that movement of the drive shaft receiver moves the tilt cord pulley.

As used herein, the term "header system" refers to the header or head rail of shade systems as that term is known and used in the art. Typically, a header system includes the header, a "C-shaped" enclosure that encompasses a shade, shade roll if it is a roll type shade, cords, cord spools, and other operational parts of a shade system. A separate header cover is also often part of a header system but may or may not be included. The header cover may be movable or removable so that access to the operational parts of the shade system is provided. Further the header cover hides the operational parts within the header from view.

Also, the term "integral" is used herein to describe a structural element that is a part of the structure itself. Metal extrusions and plastic forms, for example only, may be created to include catches and guides in the form itself. In the present invention the "integral header attachment connection" identifies an important element of the invention in that the header system itself is formed with the requisite structure to provide the required attachment element. The term also alludes to the fact that the manual shade system of the present invention includes all the features necessary for a user to quickly transform the manual shade to a motorized shade without having to add any screws, bolts, wires and the like.

Also, as used herein, the term "cord spool" refers to any type of cord roll up unit such as a spool or a translating tube or the like. Further the term "cord" includes cords, string and the like and any flexible element now known or hereafter developed.

Still further, "shade" refers to any flexible covering. In particular a "tilt shade" refers to a shade in which individual shade elements are adjustable and rotate up and down in their place in the shade when manipulated as with a Venetian blind for example only.

Further, as used herein the term "electrical connector" describes a device or combination of devices used in enabling the transmission of electricity from element to another. As described herein, an electrical connector consists of an exposed electrical carrier, such as a copper wire, for example only, in combination with an electric contact in a device. In this system electricity passes indirectly though the carrier to the electric contact and to the device, i.e. from the batteries through the electric contact to the motor. This system is illustrated in the prior pending application in FIGS. 2-11 and 14-20 in two separate manners in which the header system acts as the carrier. In another embodiment, an electrical connector consists of an extended electrical connector on one device that joins directly with an electrical connector on a power source. This system is illustrated in FIGS. 12 and 13 of the prior pending application. For purposes of general disclosure, the present application illustrates one such system in FIG. 14 herein.

In a further aspect of the invention, a drive pulley is connected with a drive shaft and the drive shaft is conformed to connect with the drive shaft receiver and an operational cord is connected with the drive pulley. In a further aspect, the invention includes a counter balance system connected with the cord spool. In one aspect the header system acts as a positive voltage carrier and a negative voltage carrier.

In a further aspect, the invention includes a motor assembly conformed to fit within the header system where the motor assembly includes a motor, a control board, an encoder and a motor drive shaft where the motor drive shaft is conformed to connect with the drive shaft receiver. A first contact and a second contact is connected with the motor assembly where the first contact is connected with the positive voltage carrier and where the second contact is connected with the negative voltage carrier when the motor assembly is within the header system.

In one aspect, a power system is provided that is conformed to connect with the integral header attachment connection and is also conformed to connect with the motor assembly.

In another aspect, an engagement element is provided on the tilt cord where the engagement element removably connects with the tilt cord pulley to tilt the shade when the engagement element is connected with the tilt cord pulley. In one aspect, the engagement element is an enlarged area on the tilt cord conformed to engage depressions in the tilt cord pulley. It should be understood that the engagement element can be any suitable element such as a bead, a knot, a grommet and even a magnet, for example only and not by way of limitation.

In one aspect, the engagement element engages the tilt cord pulley for approximately 180 degrees of rotation of the tilt cord pulley.

According to another embodiment of the invention, a motorizable tilt shade system includes a header system including a header and a header cover where the header system acts as a positive voltage carrier and a negative voltage carrier and where the header system includes a header attachment connection. A battery housing is connected with the header system and with one of either the positive voltage carrier or the negative voltage carrier. A cord spool is provided within the header and is connected with at least one suspension cord. A shade is suspended from the at least one suspension cord. A tilt cord pulley is provided within the header system and a tilt cord is connected with the tilt cord pulley and with the shade such that the tilt cord and tilt cord pulley cooperate to tilt the shade. A drive shaft receiver is connected with the tilt cord pulley such that movement of the drive shaft receiver moves the tilt cord pulley.

In one aspect the invention includes a counter balance system within the header connected with said cord spool. In another aspect the invention includes a motor assembly conformed to fit within the header system where the motor assembly includes a motor, a control board, an encoder and a motor drive shaft and where the motor assembly includes a motor assembly attachment connection conformed to connect with the header attachment connection and where the motor drive shaft is conformed to connect with the drive shaft receiver. A first contact and a second contact are provided that are connected with the motor assembly where the first contact is connected with the positive voltage carrier and where the second contact is connected with the negative voltage carrier and a power system is provided that is conformed to connect with the integral header attachment connection and is also conformed to connect with the motor assembly.

In another aspect, a drive pulley is connected with a drive shaft where the drive shaft is conformed to connect with the drive shaft receiver and an operational cord is connected with the drive pulley.

In a further aspect, the shade is selected from a group of shades consisting of: a slat shade, a mini blind shade and a pleated shade.

In one aspect, an engagement element id provided on the tilt cord where the engagement element removably connects with the tilt cord pulley to tilt the shade when the engagement element is connected with the tilt cord pulley. In another aspect, the engagement element engages the tilt cord pulley for approximately 180 degrees of rotation of the tilt cord pulley.

According to another embodiment of the invention, a method for motorizing a tilt shade system includes the steps of:

a. providing a header system where the header system includes an integral header attachment connection, at least one cord spool within the header system connected with at least one suspension cord, a shade suspended from the at least one suspension cord, a tilt cord pulley and a tilt cord connected with the tilt cord pulley and the shade, a drive shaft receiver connected with the tilt cord pulley such that movement of the drive shaft receiver moves the tilt cord pulley; and b. moving the drive shaft receiver.

In one aspect, the method further includes providing a drive pulley with a drive shaft where the drive shaft is connected with the drive shaft receiver and connecting an operational cord with the drive pulley.

In another aspect, the method further includes:

a. providing a motor assembly conformed to fit within the header system where the motor assembly includes a motor, a control board, an encoder and a motor drive shaft and where the motor assembly includes a motor assembly attachment connection conformed to connect with the header attachment connection and where the motor drive shaft is connected with the drive shaft receiver;

b. providing a first contact and a second contact connected with the motor assembly where the first contact is connected with a positive voltage carrier and where the second contact is connected with a negative voltage carrier; and c. a power system connected with the integral header attachment connection and with the motor assembly.

In a further aspect, the method further includes an engagement element on the tilt cord where the engagement element removably connects with the tilt cord pulley to tilt the shade when the engagement element is connected with the tilt cord pulley.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
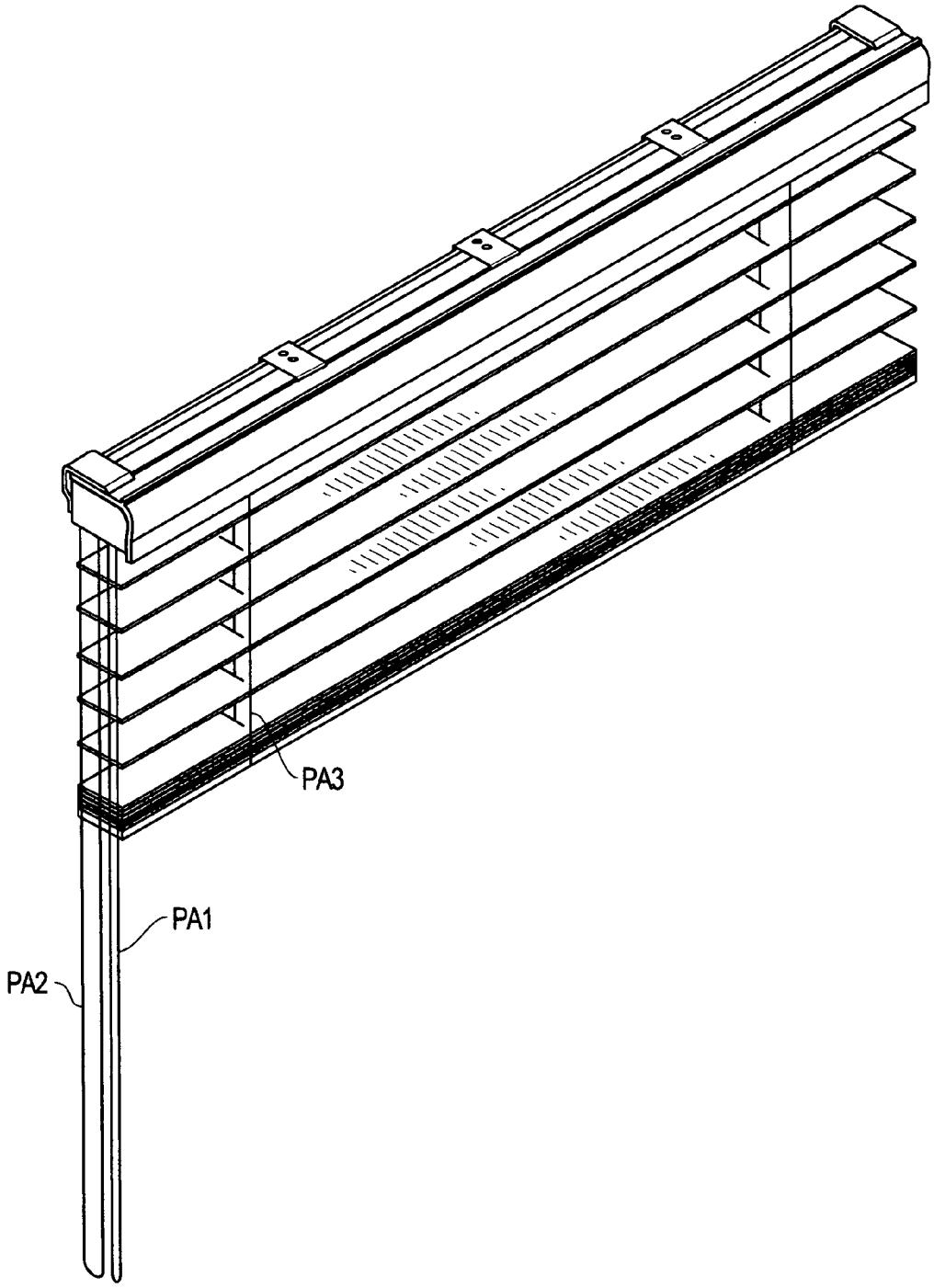
FIG. 1 (Prior Art)
FIG. 1 is a perspective view of a prior art slat type blind with two manually operated operation cords, one for raising and lowering the blind and one for tilting the slats.

The preferred embodiment of the present invention is illustrated by way of example in FIGS. 2-10. With specific reference to FIG. 1, a prior art slat type shade system of a cover assembly for windows and or doors or the like, includes, among other things, two cords. Cord PA1 is used for raising and lowering the blind and cord PA 2 is used for tilting the slats. Suspension cord PA 3 suspends the slats in alignment from top to bottom.

Figure 3:
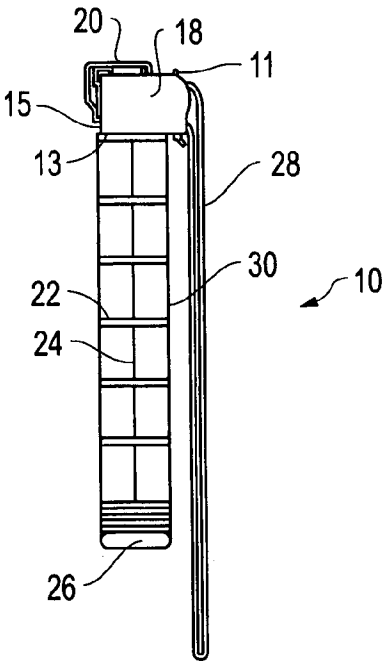
FIG. 3 is an end view of FIG. 2.
Figure 2:
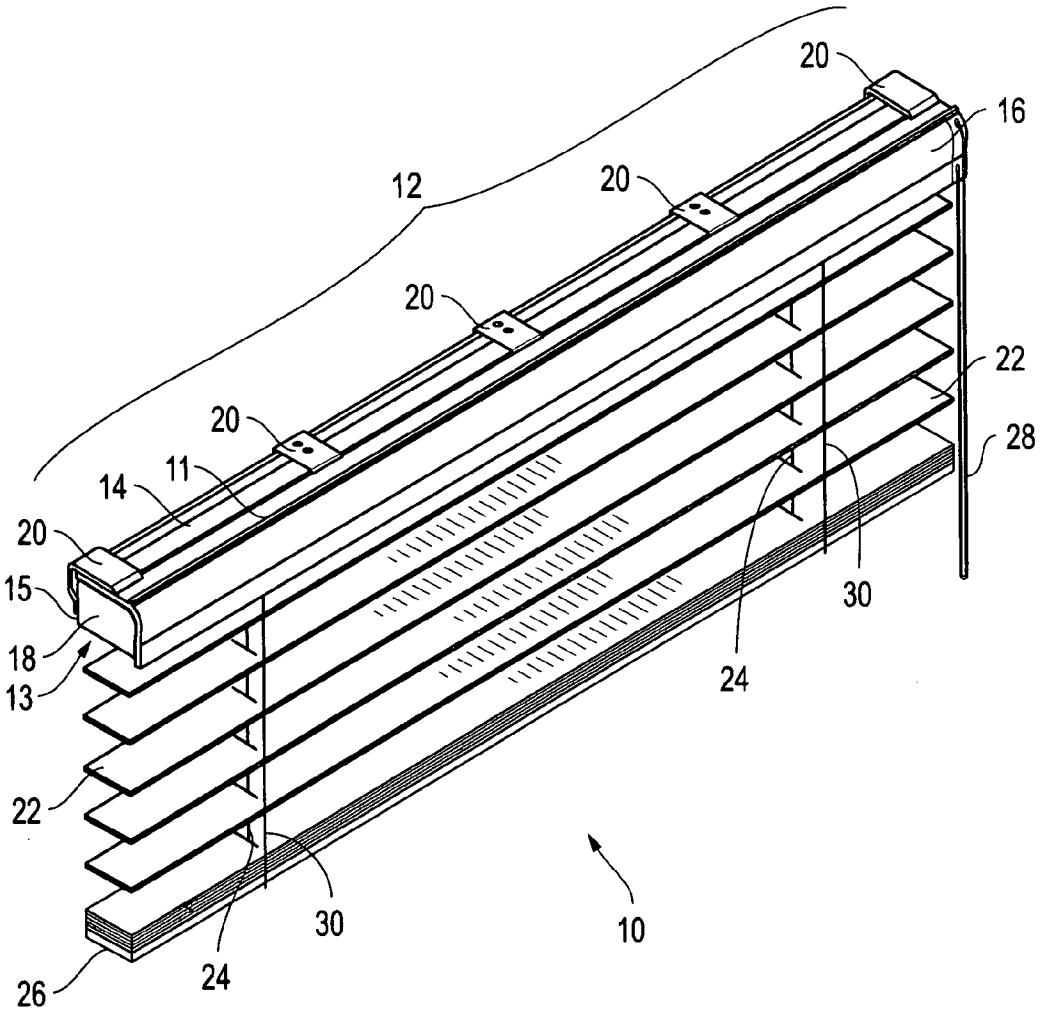
FIG. 2 is a perspective view of the motorizable tilt shade system of the present invention according to one embodiment illustrating only one manual operation cord that provides both the raising and the lowering of the blind and the tilting of the slats.

Referring now to FIGS. 2 and 3, the motorizable tilt shade system 10 according to one embodiment of the present invention includes header assembly 12. Header assembly 12 includes a header 14, a front cover 16, end caps 18, and support brackets 20, as is known in the art. As can be seen from the figures, header 14 is generally "C" shaped with a top 11, a bottom 13 and a connecting back 15. The "front" is open and covered by front cover 16, all as known in the art.

FIGS. 2 and 3 also show slats 22, which form the shade of the system, suspended from suspension cord 24. Suspension cord 24 is connected on one end with bottom bar 26. Also shown are operational cord 28 and tilt cord 30. Because of the presence of the suspension cord 24, the system shown in these figures is a "corded" system including the potentially problematical manually operated operational cord 28. Tilt cord 30, however, is not manually operable as is the prior art cord for tilting a blind PA2, as will be discussed more fully hereafter.

Figure 4:
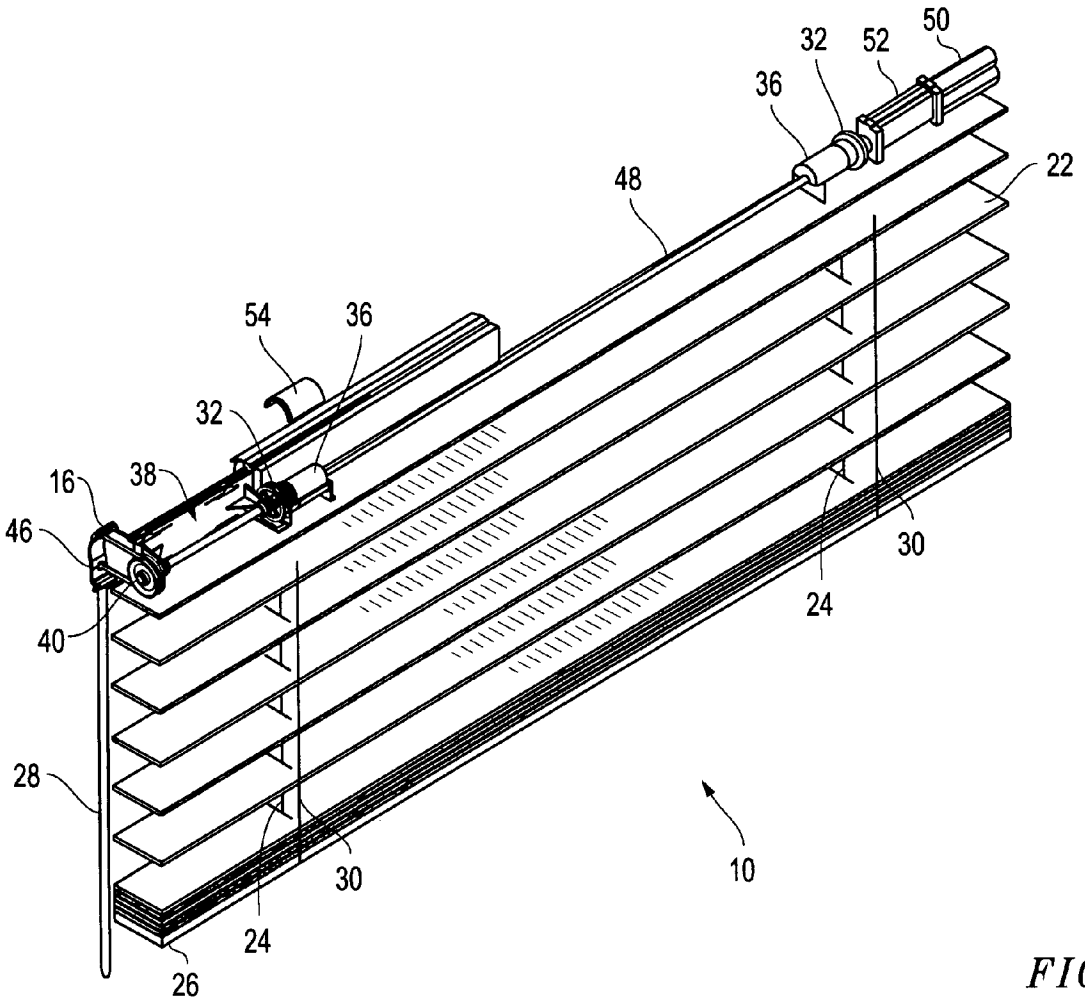
FIG. 4 is a backside perspective view of FIG. 1 with the header and end caps removed to show the inner components.

Referring now to FIG. 4, one embodiment of the motorizable tilt shade system 10 includes a tilt cord pulley 32. Tilt cord 30 is connected with tilt cord pulley 32 by passing over the tilt cord pulley 32 as illustrated and as will be described more fully hereafter.

Figure 7:
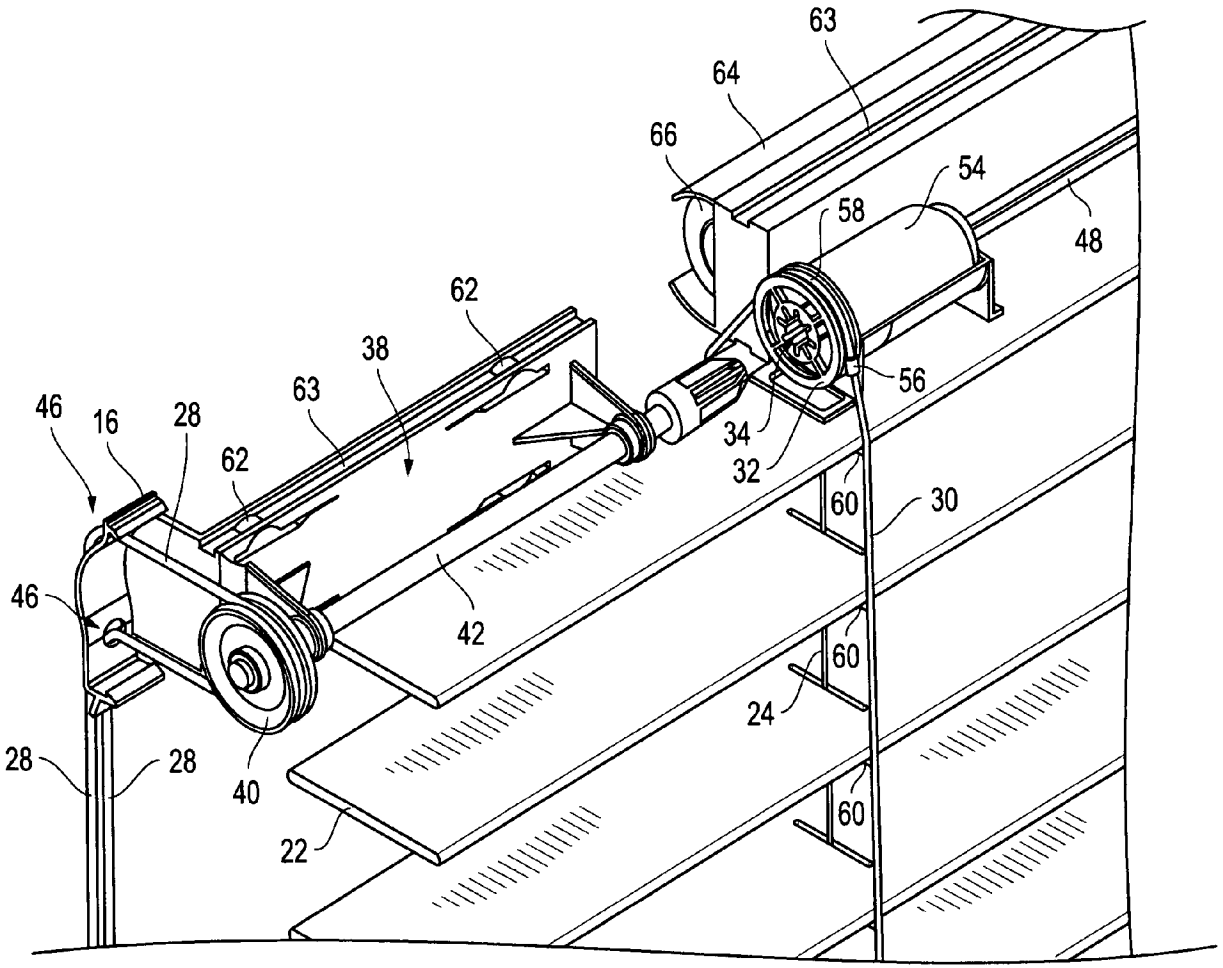
FIG. 7 is an enlarged perspective view similar to FIG. 5 with the single manual adjustment cord and pulley system in the process of being installed or removed.

Importantly, tilt cord pulley 32 includes a drive shaft receiver 34 as more clearly shown in FIG. 7. At this point in the discussion, it need be understood that movement of the drive shaft receiver 34 results in movement of tilt cord pulley 32.

FIG. 4 also shows cord spool 36 to which suspension cord 24 is connected. Suspension cord 24 is wrapped onto and off of cord spool 36 according to the operation of the cord spool 36. Importantly, tilt cord pulley 32 is connected with cord spool 36 such that movement of tilt cord pulley 32 by means of drive shaft receiver 34 results in movement of cord spool 36.

FIG. 4 illustrates the embodiment of the invention in which a manual adjustment assembly 38 is provided. Manual adjustment assembly 38 includes drive pulley 40 with a drive shaft 42. Drive shaft 42 is conformed to connect with drive shaft receiver 34. Drive pulley 40 and drive shaft 42 are supported by supports 44 connected with manual adjustment assembly 38.

Manual adjustment assembly 38 is connected within header assembly 12 by means of integral header attachment connection 17 as is fully described in the above referenced co-pending application and as will be described more fully hereafter. Generally stated, however, integral header attachment connection 17 consists of connection elements conformed to cooperate with elements of removable assemblies such as manual adjustment assembly 38, for example only. For example only and not by way of limitation, header attachment connection may consist of header protrusions 80 (as clearly shown in FIG. 10 for example only). Header protrusions 80 are received within alignment grooves 63 such that manual adjustment assembly 38 is simply slid into place within header assembly 12 connected thereto by the integral header attachment connection 17. Integral header attachment connection 17 may also include indents that cooperate with biased catches 62 in the manual adjustment assembly 38, for example only, to secure manual adjustment assembly in a desired location within header assembly 12, again for example only and not by way of limitation.

Importantly, operational cord 28 is connected with drive pulley 40, looping around drive pulley 40 and passing out of apertures 46 in front cover 16. Manual operation of operational cord 28 moves drive pulley 40 which turns drive shaft 42 which, in turn, moves tilt cord pulley 32 which turns the cord spool 36 and raises and lowers slats 22 as a first function.

Still referring to FIG. 4, it is shown that more than one cord spool 36 may be used with the system connected one with the other by spool shaft 48. Also, preferably a counterbalance 50 and a transmission 52 connected with the cord spool 36 has been found to greatly assist in the operation of the motorizable tilt shade system 10 of the present invention with or without operational cord 28. FIG. 4 also shows cord spool cover 54.

Figure 5:
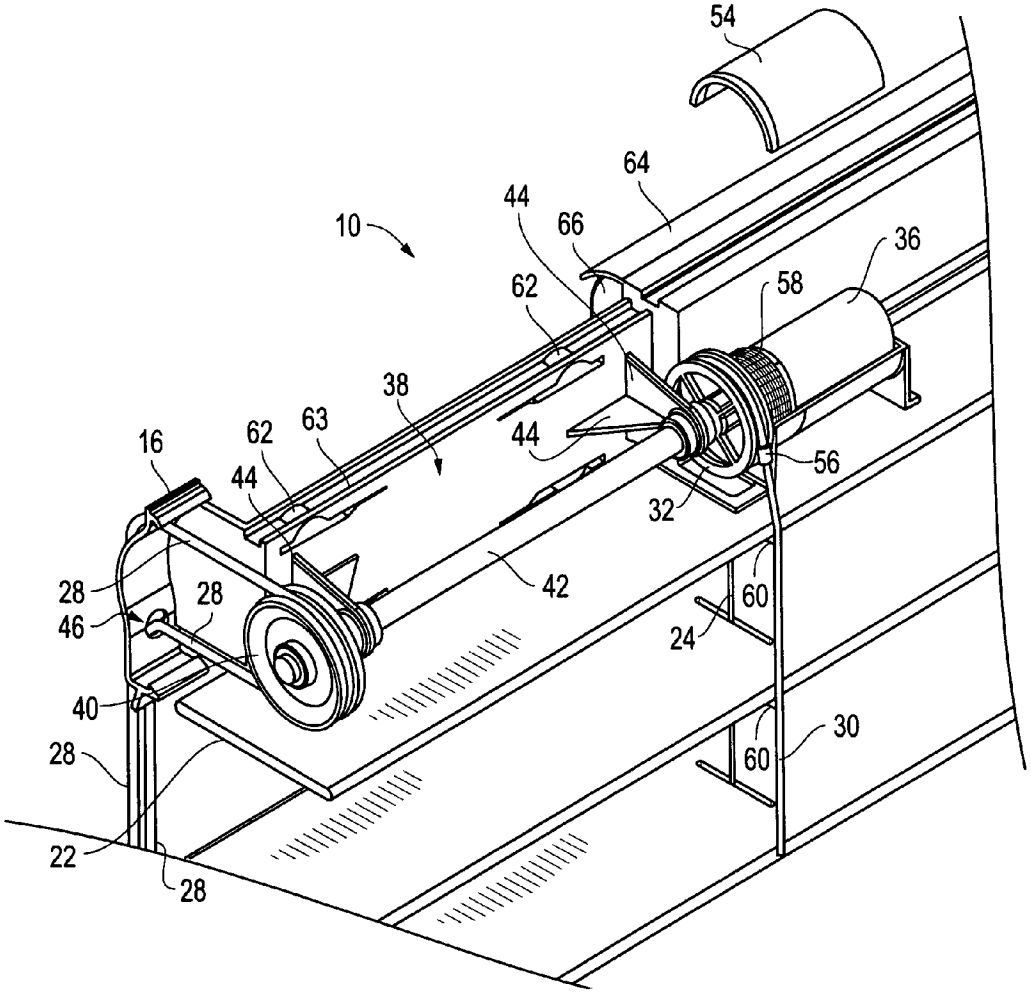
FIG. 5 is and enlarged perspective view of the left hand side of FIG. 4 showing a single manual adjustment operational cord.

Referring now to FIG. 5, an enlarged view of the left hand side of FIG. 4 is provided. This view illustrates an important feature of one embodiment of the invention in which tilt cord 30 includes an engagement element 56. Engagement element is an enlarged area of tilt cord 30. This enlarged area may be created in any useful manner such as by adding a bead, a knot or a grommet, for example only and not by way of limitation. In operation, engagement element 56 temporarily engages or connects with tilt cord pulley 32 as the tilt cord 30 passes over the tilt cord pulley 32. According to one aspect of the invention, tilt cord pulley 32 includes recesses 58 which capture engagement element 56 as the element passes onto and off of tilt cord pulley 32. This engagement results in movement of slats 22 since tilt cord 30 is connected side to side beneath slats 22 by cross connectors 60.

FIG. 5 also shows biased catches 62 and alignment grooves 63 in manual adjustment assembly 38. Biased catches 62 cooperate with spaces or indents in the header 14, not shown, and grooves 63 with protrusions in header 14 not shown, thus creating the integral header attachment connection 17 discussed above for retaining manual adjustment assembly 38 in place. Also shown is battery compartment 64 and batteries 66 as will be discussed more fully hereafter.

Figure 6:
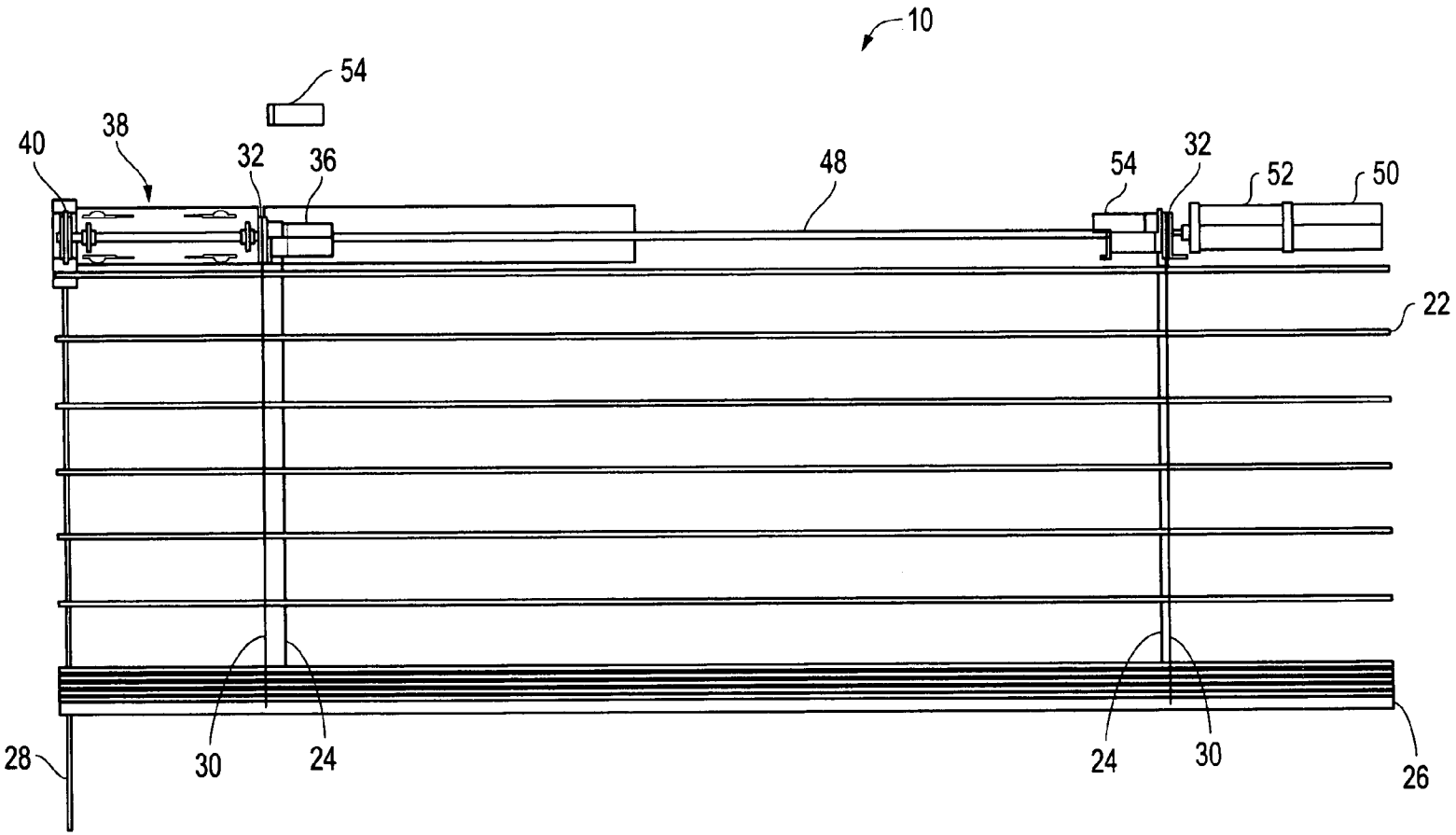
FIG. 6 is a plan view of FIG. 4.

FIG. 6 is a plan view of FIG. 4 showing the same elements described above.

FIG. 7 is an enlarged view as with FIG. 5 but showing manual adjustment assembly 38 being added or removed. Again, drive shaft receiver 34 is clearly shown as is the end of drive shaft 42 which is conformed to connect with drive shaft receiver 34. This figure shows how easily and simply a manual operating system may be added to or removed from an existing motorizable tilt shade system 10 according to the present invention.

Figure 8:
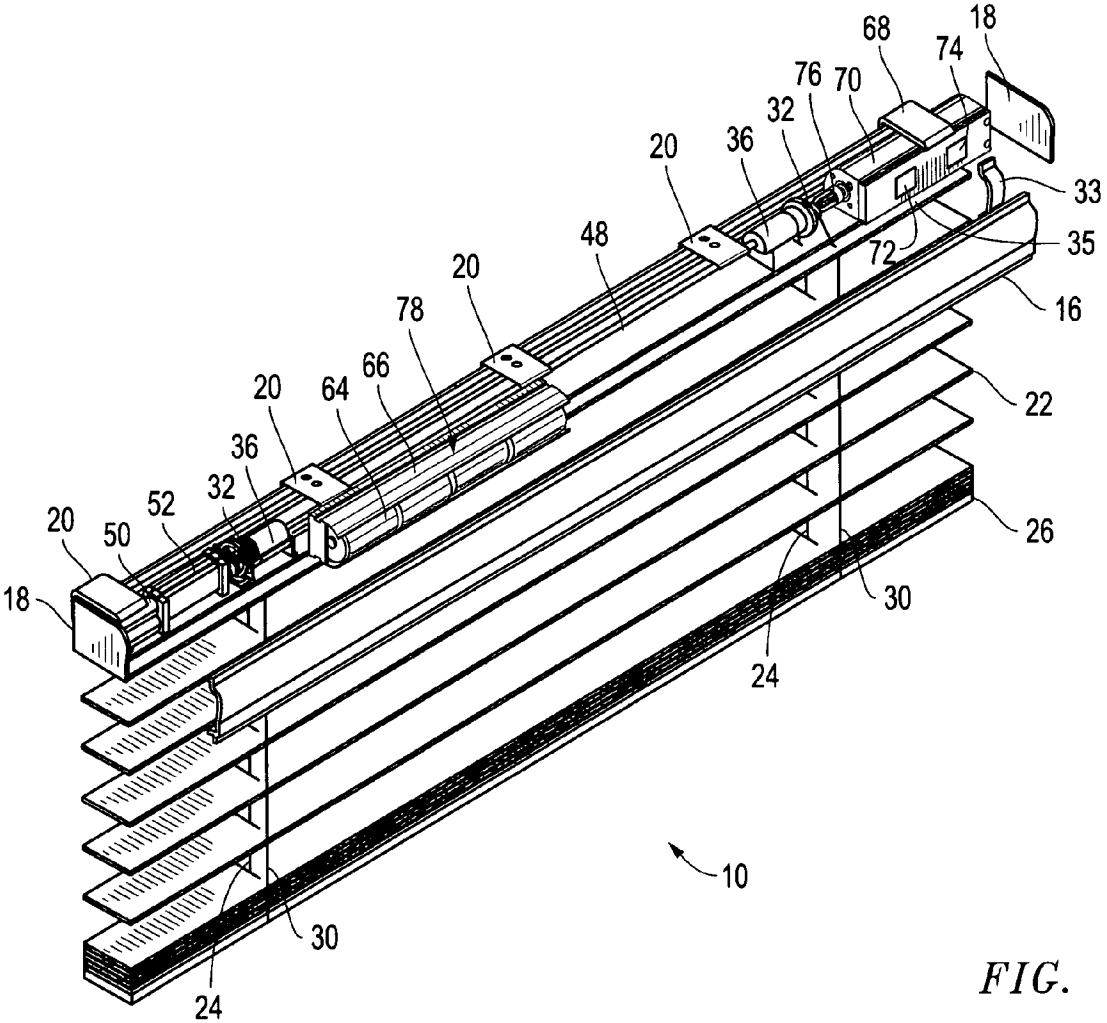
FIG. 8 is a partially exploded perspective view of the motorizable tilt shade system of this invention with a motor assembly and batteries installed that eliminates the need for an operational cord.
Figure 9:
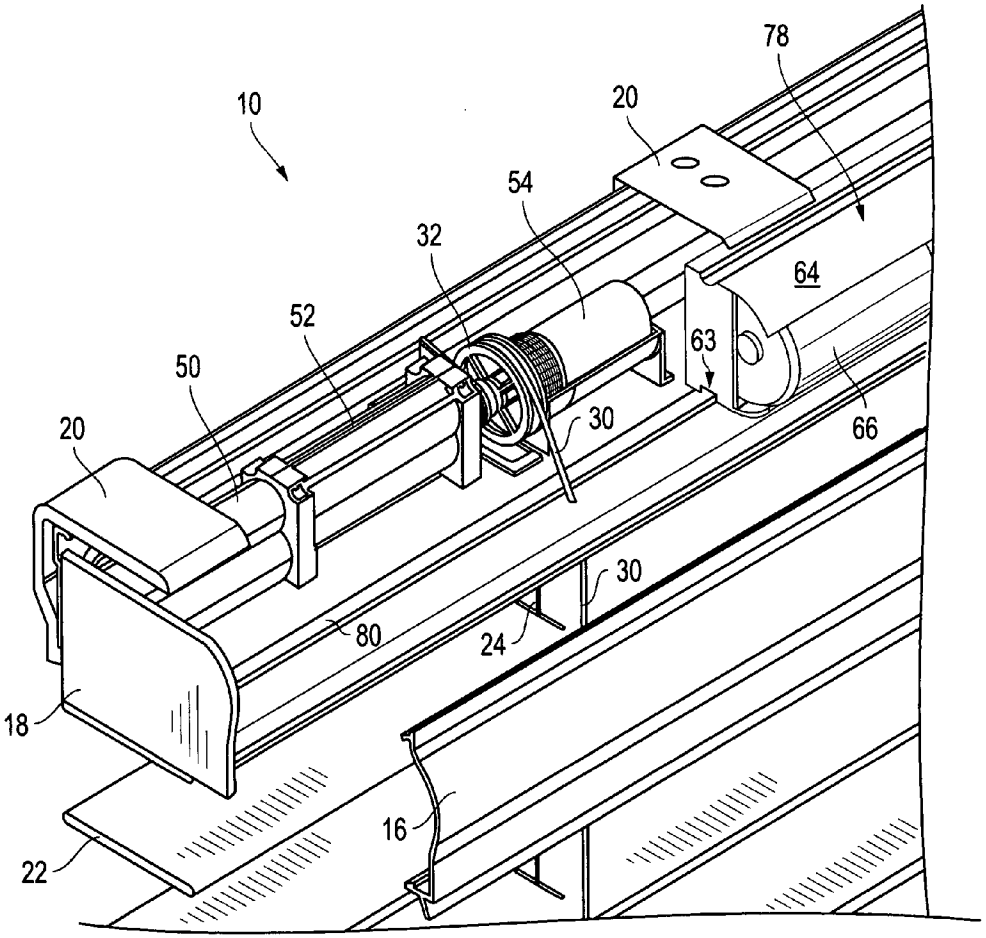
FIG. 9 is an enlarged perspective view of the left side of FIG. 8.

Referring now to FIGS. 8 and 9, according to another embodiment of the invention, motor assembly 68 includes a motor 70, control board 72, encoder 74, and motor drive shaft 76. Motor drive shaft 76 is conformed to connect with drive shaft receiver 34 as described above with regard to drive shaft 42. Header assembly 12 includes a positive voltage carrier 21 and a negative voltage carrier 23 and motor assembly 68 includes a first contact 82 and a second contact 84 (See FIG. 14) for connection therewith as described more fully with regard to FIG. 14 hereafter and in the co-pending application identified herein.

Power system 78 consists of battery compartment 64 with batteries 66. Power system 78 connects with motor assembly 68 and motorizes motorizable tilt shade system 10 when in place.

FIG. 9 is an enlarged view of the left side of FIG. 8 showing the counterbalance 50 and transmission 52 in place and connected with a cord spool 36.

Figure 10:
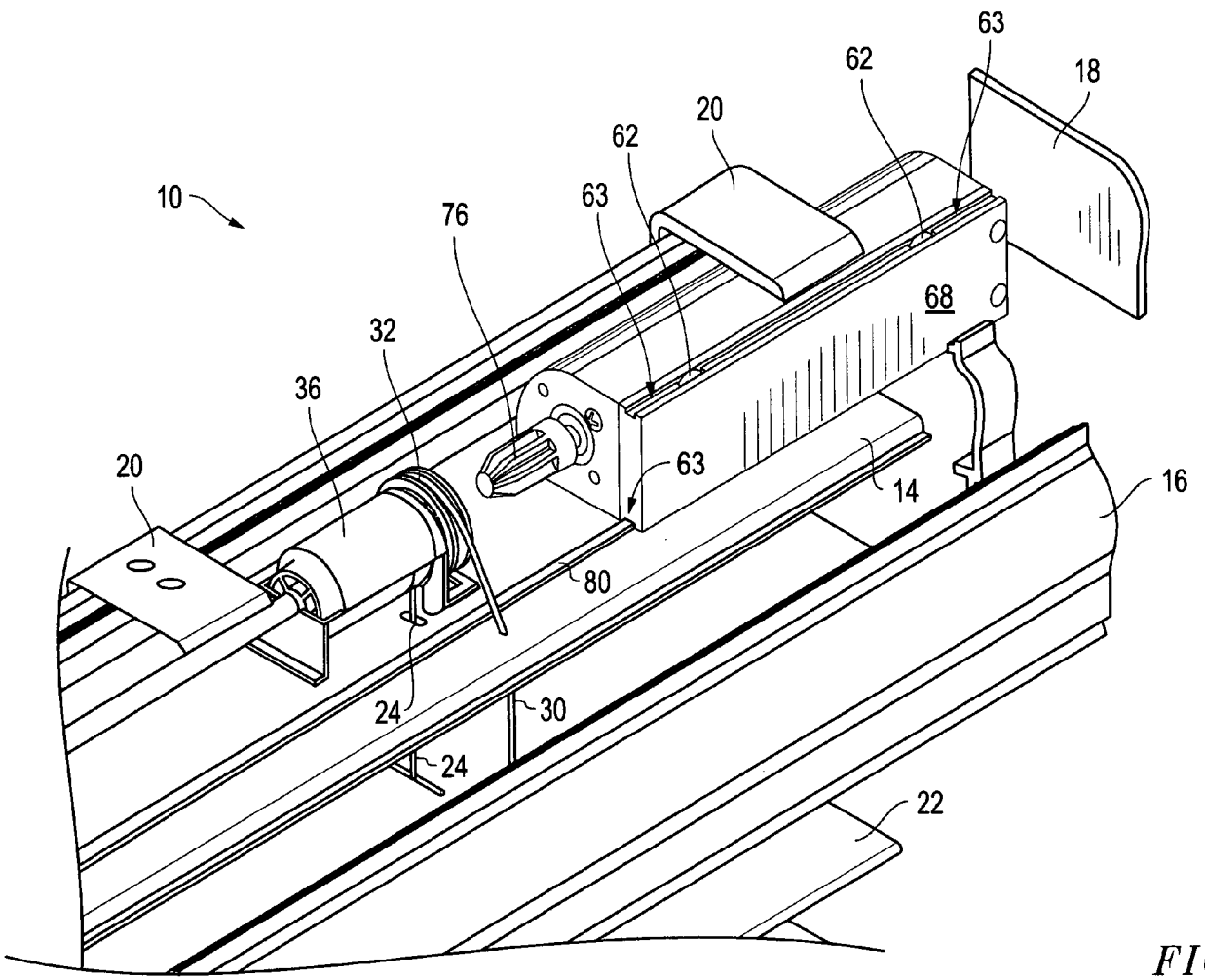
FIG. 10 is an enlarged perspective view of the right side of FIG. 8.

FIG. 10 is an enlarged view of the right side of FIG. 8 showing motor assembly 68 and motor assembly drive shaft 76 being connected with or withdrawn from drive shaft receiver 34 in tilt cord pulley 32. When connected, there is no need for operational cord 28 and it may be removed.

FIG. 10 illustrates header protrusions 80 which, again, receive alignment grooves 63 in motor assembly and, along with biased catches 62, create the integral header attachment connection 17 that holds motor assembly 68 in place when connected with in header assembly 12.

In operation, motorizable tilt shade system 10 is manually operable as shown in FIGS. 2-7. In this configuration, the user pulls on one side of operational cord 28 to either raise the slats 22 or pulls on the opposite side of the operational cord 28 to lower the slats. Importantly, the present invention provides both the raising and lowering function as well as the tilt function with one manual cord.

Figure 11:
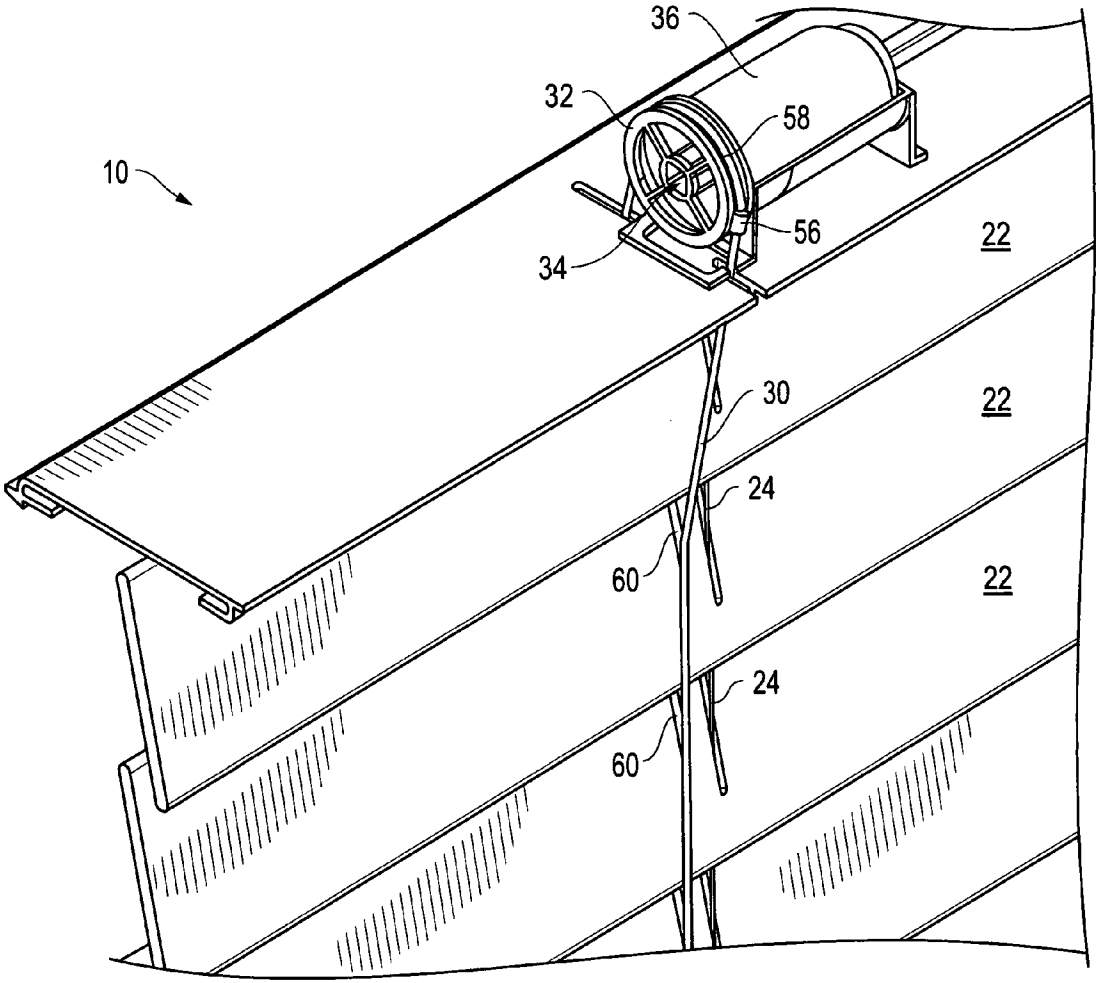
FIG. 11 is an enlarged perspective view showing the slats closed in a first position and the engagement element just connecting with the tilt cord pulley.

The tilting feature is best illustrated with reference to FIGS. 11-13. In FIG. 11 the tilt cord 30 has engagement element 56 that mates or conforms to the recesses 58 in the tilt cord pulley 32 as described above. The engagement element 56 will only move tilt cord pulley 32 of tilt cord 30 an amount equal to 180 degrees of movement of the tilt cord pulley 32. To tilt the slats 22, the tilt cord 30 with engagement element 56 engages recesses 58, for example only, in the tilt cord pulley 32 when the operational cord 28 turns the drive pulley 42 and the drive shaft 42 turns the tilt cord pulley 32. In FIG. 11, the engagement element 56 has just engaged tilt cord pulley 32 and slats 22 are in a first closed position.

Figure 12:
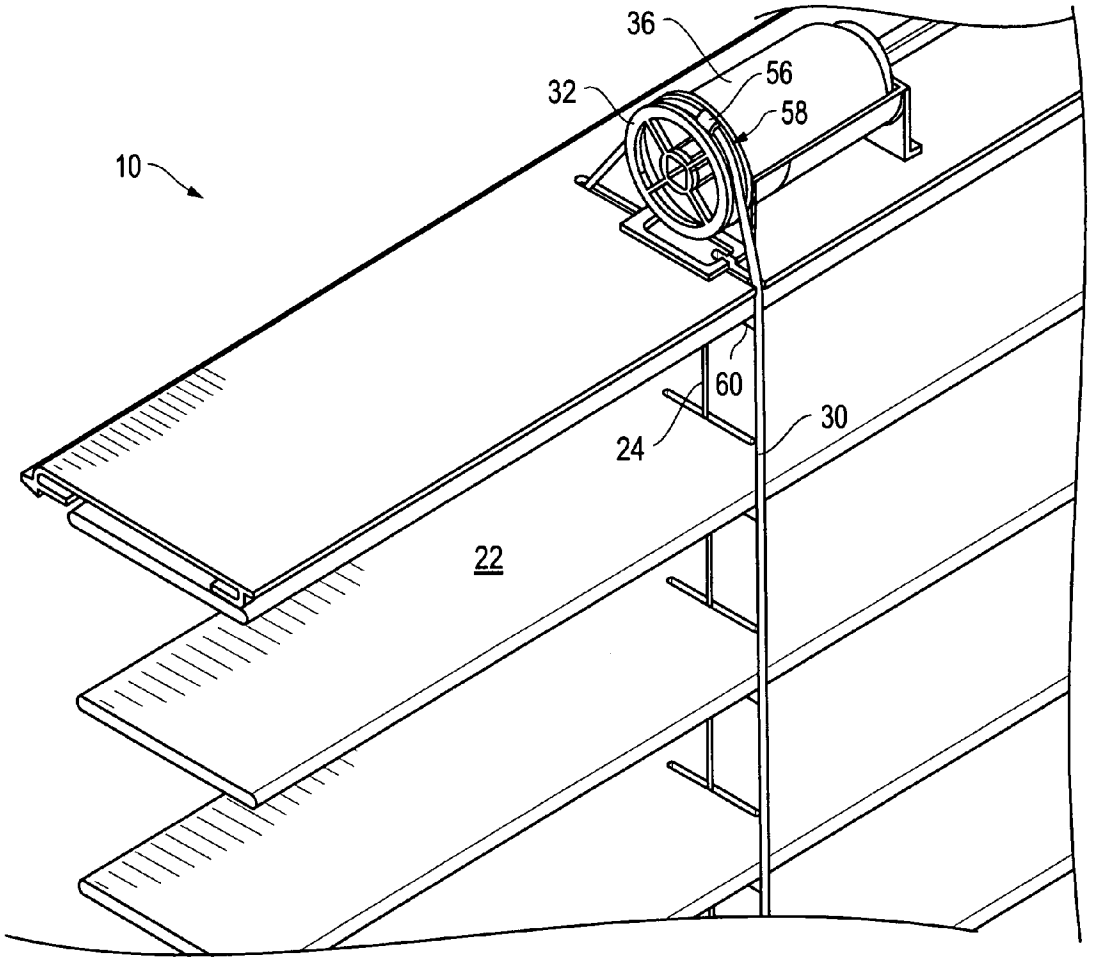
FIG. 12 is an enlarged perspective view of FIG. 10 showing the movement of the slats to a fully open position as the engagement element rotates tilt cord pulley 90 degrees.

Tilting continues as shown in FIG. 12 by the rotation of tilt pulley 32 approximately 90 degrees such that the slats 22 are in the most fully open position.

Figure 13:
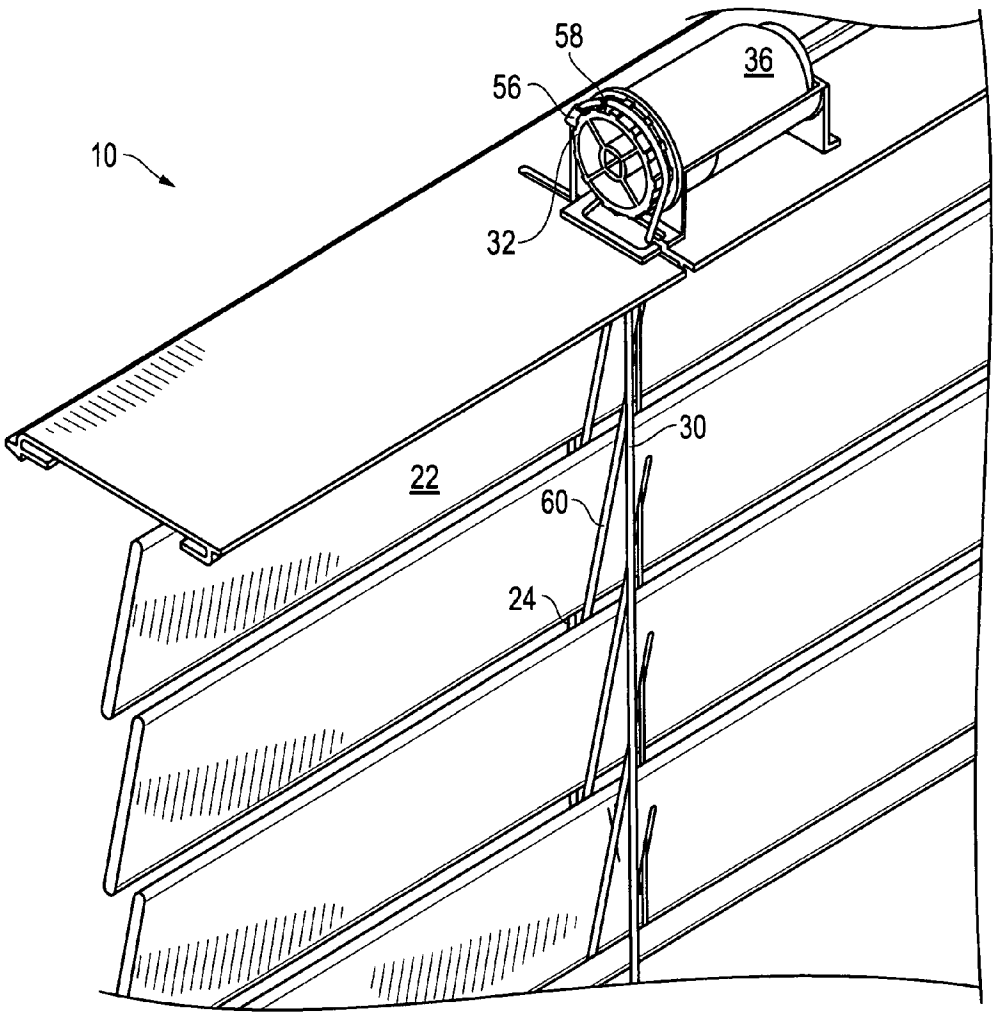
FIG. 13 is an enlarged perspective view of FIG. 12 showing the movement of the slats to a closed second position as the engagement element rotates tilt cord pulley another 90 degrees before losing contact with the tilt cord pulley.

Tilting of slats 22 continues as the tilt cord pulley 32 is rotated another approximate 90 degrees to a second closed position shown in FIG. 13. Titling thus continues until the engagement element 56 leaves the recesses 58. After that, tilt cord 30 simply passes over tilt cord pulley 32 without moving it and tilting of the slats 22 stops. Continuing to pull on the operational cord 28 when present, or operation of motor 70 when present, continues to turn cord spools 36 and pay off the stored suspension cord 24 and lowers, for example, the slats 22 in a tilted configuration. When the slats 22 are lowered to the desired location, a pull on the opposite side of the operational cord 28 or activation of the motor 70 in the reverse allows the user to position the slats 22 at the desired angle by the reverse process.

To raise the slats 22, the operational cord 28 must be pulled, or motor 70 operated, in the opposite direction. When the slats 22 are raised to the desired location, the pull on the operational cord 28, or the direction of operation of motor 70, is reversed to tilt the slats 22 as desired.

FIGS. 8-10 show the motorized version of the invention where the manual adjustment assembly 38 is removed and replaced with the motor assembly 68 and power system 78. Thereafter, the operational cord 28 may be removed altogether and the slats 22 manipulated as described above by operation of the motor drive shaft 76 in one direction or the other. Likewise, should the user desire it, the motorized system may be changed back to a manual system by the reverse process.

Figure 14:
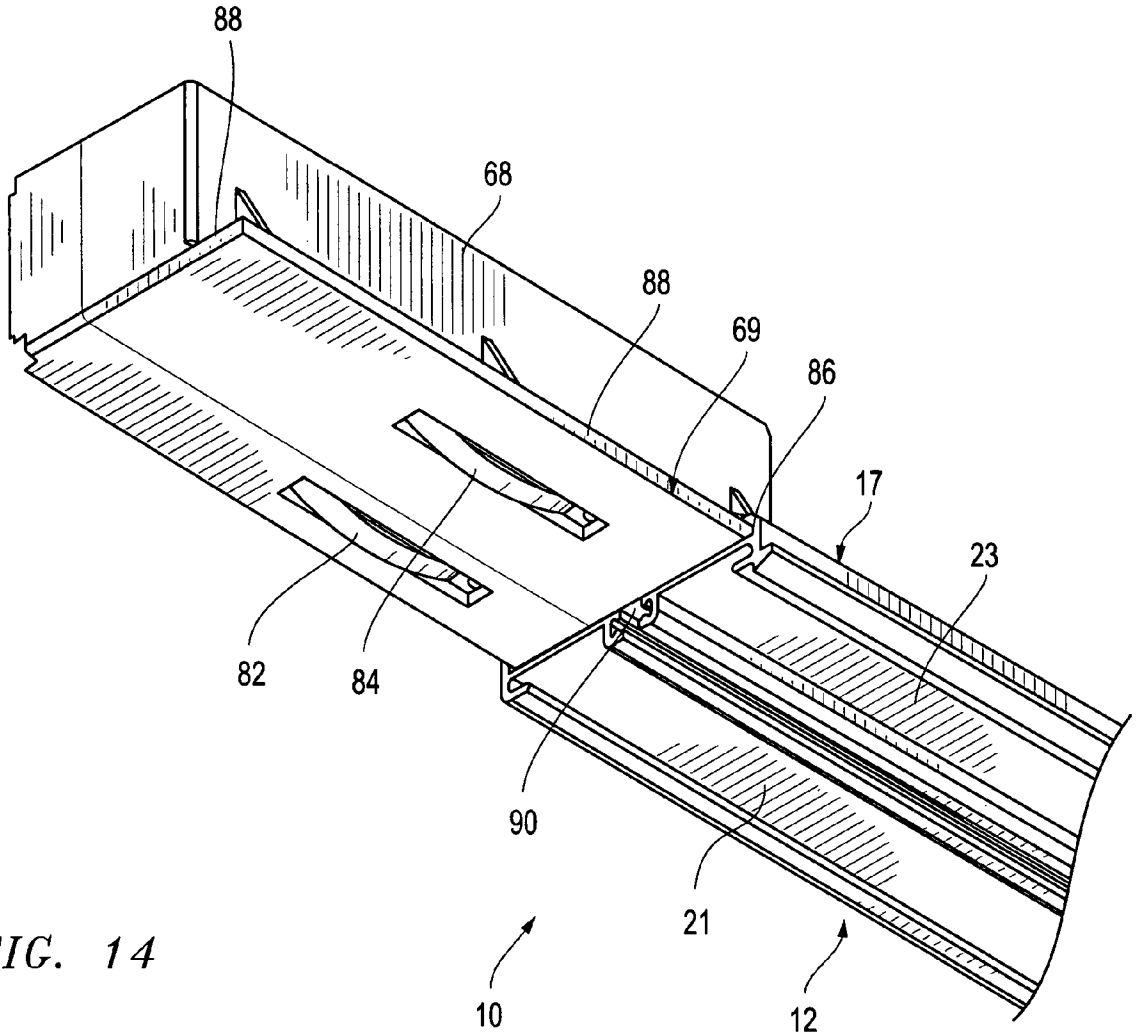
FIG. 14 is a bottom up partial perspective view showing the motor assembly and the positive and negative voltage carriers and an insulator.

By way of further discussion, referring now to FIG. 14, important features of the present invention are shown in detail. In particular, FIG. 14 shows first contact 82 and second contact 84 as they are connected to the motor assembly 68. As such, again, first contact 82 comes into contact with and makes an electrical connection with positive voltage carrier 21 and second contact 84 comes into contact with and makes an electrical connection with negative voltage carrier 23 when, and only when the user desires to "motorize" the motorizable tilt shade system 10. When motor assembly 68 is inserted within header assembly 12 the electrical connections are made. Insulator 90 insulates positive voltage carrier 21 from negative voltage carrier 23. Insulator 90 may be any form of insulator now known or hereafter developed such as a rubber material for example only.

In one aspect of the invention, first contact 82 and second contact 84 are "biased springs" that resist compression and thus maintain tight contact when compressed. This compression is accomplished, for example only and not by way of limitation, by the use of the leaf spring contacts, 82 and 84, in combination with an integral header attachment connection 17 in the header assembly 12 and a motor assembly attachment connection 69 in the motor assembly 68.

For the purpose of example only and not by way of limitation, integral header attachment connection 17 in the header assembly 12 consists of an overhanging lip 86 and motor assembly attachment connection 69 in the motor assembly 68 consists of an extended edge 88. Extended edge 88 is captured within overhanging lip 86 as motor assembly 68 is inserted into header assembly 12. This keeps motor assembly 68 securely connected with header assembly 12 such that biased spring connectors, first contact 82 and second contact 84, are compressed as the motor assembly 68 is inserted into the header assembly 12 and thus kept pressed tightly against positive voltage carrier 21 and negative voltage carrier 23. Power system 78 is easily and securely connected with header assembly 12 by these same elements or by means of power attachment grooves 63 in cooperation with header protrusions 80 as described above (See FIGS. 8 and 9).

Certainly other forms of integral header attachment connections 17 and motor assembly attachment connections 69 and power attachment connections as may be desired are included within the scope of the invention.

Figure 15:
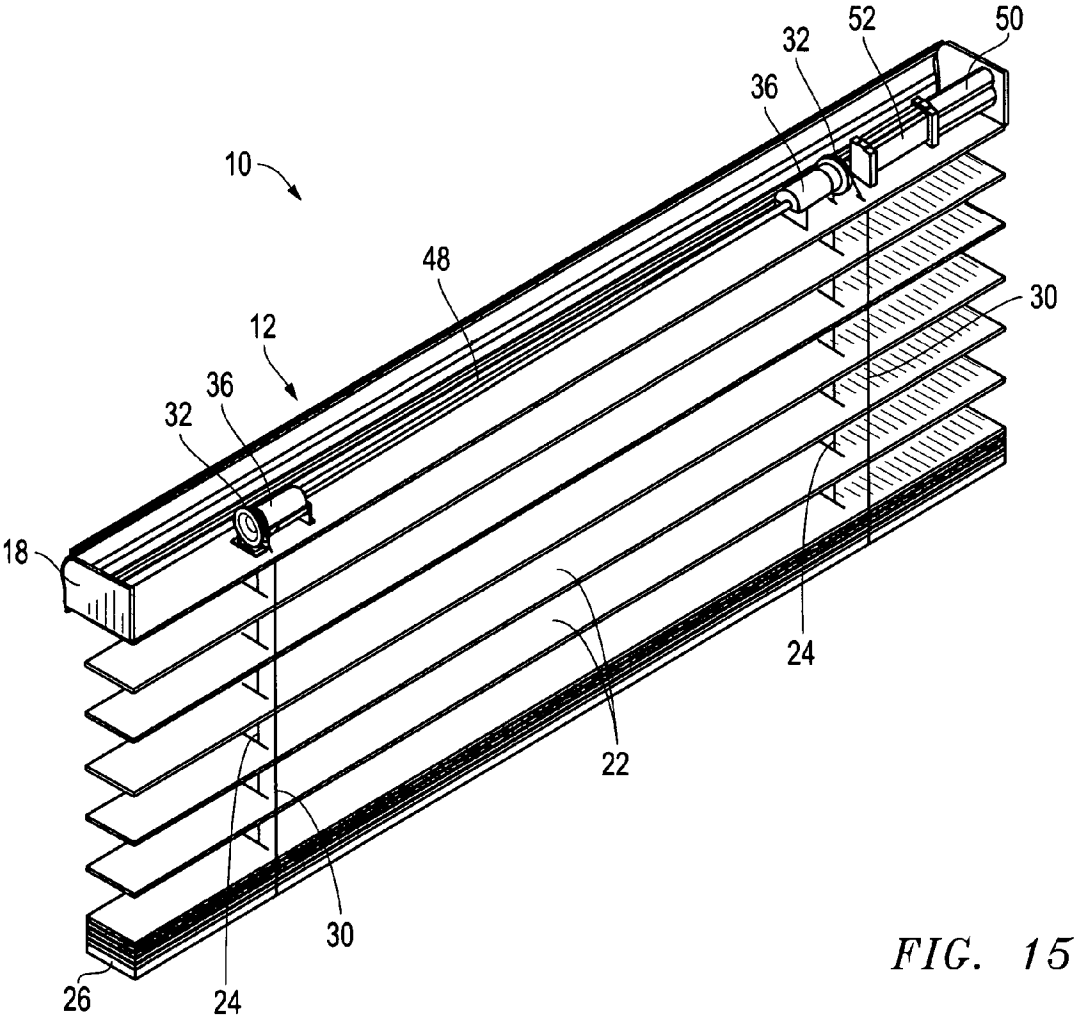
FIG. 15 is a perspective view of a corded, cordless tilt shade system.

FIG. 15 is provided to illustrate a corded, cordless tilt shade system. It is "corded" because it includes suspension cords 24 and it is "cordless" because it does not include an operational cord 28 as shown in FIGS. 2 and 3 for example. As it is shown in FIG. 15, the shade is ready to be made into a manually operable tilt shade system by the addition of manual adjustment assembly 38. Just as easily, the shade is ready to be made into to a motorized shade system by the addition of motor assembly 68 and power system 78 as described herein. Thus, it should be understood that the used can utilize the same shade system and easily switch back and forth from manual to motorized whenever desired. No complicated disassembly or special tools are required and the result is a consistent looking shade no matter what decision is made.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A motorizable tilt shade system comprising:

a header system, with an inside and an outside, wherein the header system includes an integral header attachment connection wherein the integral header attachment connection comprises a preformed guide on the inside of the header system;

at least one cord spool within the header system connected with at least one suspension cord;

a shade suspended from the at least one suspension cord;

a first tilt cord pulley connected with the at least one cord spool;

a tilt cord connected with the first tilt cord pulley and with the shade such that the tilt cord and first tilt cord pulley cooperate to tilt the shade;

a spool shaft operably connected to the at least one cord spool and the first tilt cord pulley;

a drive shaft receiver operably connected with the spool shaft such that movement of the drive shaft receiver simultaneously moves the spool shaft, the first tilt cord pulley and the at least one cord spool;

a power system positioned within the header system and electrically connected to the motor thereby providing power to the motor;

a counter balance system operably connected with the cord spool to provide a counter balance force to weight of the shade;

a motor assembly having a motor assembly attachment connection conformed to removably connect the said integral header attachment connection such that the motor assembly is added to and removed from the header system along the preformed guide;

the motor assembly having a motor drive shaft conformed to connect with the drive shaft receiver such that when the motor assembly is added to the header system along the performed guide, the motor drive shaft engages the drive shaft receiver; and wherein the shade operates by the motor assembly when the motor assembly is added to the header system.

2. The apparatus of claim 1 further including:

wherein a top end of the tilt cord loops over and frictionally engages the first tilt cord pulley, such that when the spool shaft is initially rotated slats of the shade are tilted.

3. The apparatus of claim 1 further comprising wherein the drive shaft receiver is formed in the first full tilt cord pulley.

4. The apparatus of claim 1 wherein once the slats are fully tilted, the first tilt cord pulley spins within the tilt cord as the at least one cord spool raises or lowers the shade.

5. The apparatus of claim 1 further comprising:

wherein the motor assembly is conformed to fit within the header system wherein the motor assembly includes a motor, a control board, and an encoder and wherein the motor drive shaft includes features that matingly engage cooresponding features in the drive shaft receiver.

6. The apparatus of claim 1 wherein the power system is conformed to operably connect with the integral header attachment connection.

7. The apparatus of claim 1 further including an engagement element on the tilt cord wherein the engagement element intermittently connects with the first tilt cord pulley to assist with tilting the shade when the engagement element is connected the said tilt cord pulley.

8. The apparatus of claim 1 wherein the at least one cord spool, the first tilt cord pulley, the spool shaft, and the drive shaft receiver rotate simultaneously with one another.

9. The apparatus of claim 1 wherein the at least one cord spool, the first tilt pulley, the spool shaft, and the drive shaft receiver rotate around the same axis of rotation.

10. A motorizable tilt shade system comprising:

a header system including a header and a header cover wherein the header system includes a header attachment connection that forms a preformed guide;

a battery housing connected with the header system;

a first cord spool within the header connected with a first suspension cord;

a shade suspended from the first suspension cord;

a first tilt cord pulley within the header system;

a first tilt cord connected with the first tilt cord pulley and with the shade such that the first tilt cord and first tilt cord pulley cooperate to tilt the shade;

a spool shaft connected with the first cord spool and the first tilt cord pulley;

a drive shaft receiver operably connected with spool shaft such that movement of the drive shaft receiver moves the first tilt cord pulley;

a motor assembly having a motor assembly attachment connection conformed to slide along the preformed guide of the header attachment connection;

the motor assembly having a motor drive shaft conformed to connect with the drive shaft receiver such that when the motor assembly is added to the header system along the preformed guide, the motor drive shaft engages the drive shaft receiver;

wherein a top end of the tilt cord loops over and frictionally engages the first tilt cord pulley, such that when the spool shaft is rotated slats of the shade are tilted; and wherein once the slats are fully tilted, the first tilt cord pulley spins within the tilt cord as the at least one cord spool raises or lowers the shade.

11. The apparatus of claim 10 further including a counter balance system within the header connected with the spool shaft so as to provide a counter balance force to the spool shaft.

12. The apparatus of claim 10 wherein the motor assembly includes a motor, a control board, and an encoder.

13. The apparatus of claim 1, wherein the motor assembly slides along a length of the preformed guide when installed into the header.

14. The apparatus of claim 10 wherein said shade is selected from a group of shades consisting of: a slat shade, and a mini blind shade.

15. The apparatus of claim 10 further including an engagement element on the first tilt cord wherein the engagement element intermittently connects with the first tilt cord pulley to said with tilting the shade when the engagement element is connected with the first tilt cord pulley.

16. The apparatus of claim 15 wherein the engagement element engages said tilt cord pulley for approximately 180 degrees of rotation of the first tilt cord pulley.

17. A motorizable tilt shade system comprising:

a header system, with an inside and an outside, wherein the header system includes an integral header attachment connection wherein the integral header attachment connection comprises a preformed guide on the inside of the header system;

a spool shaft positioned within the header system and rotatably connected to the header system;

a first tilt cord pulley and a second tilt cord pulley operably connected with the spool shaft;

a first cord spool and a second cord spool operably connected with the spool shaft;

a first tilt cord connected with the first cord pulley, and a second tilt cord connected with the second tilt cord pulley;

a first suspension cord connected with the first cord spool and a second suspension cord connected with the second cord spool;

a shade suspended from the first suspension cord and the second suspension cord;

a drive shaft receiver connected with the spool shaft such that movement of the drive shaft receiver simultaneously moves the spool shaft, first cord spool, second cord spool, first tilt cord pulley and second tilt cord pulley;

a motor assembly having a motor assembly attachment connection conformed to removably connect with the integral header attachment connection such that the motor assembly is added to and removed from the header system along the preformed guide;

the motor assembly having a motor drive shaft conformed to connect with the drive shaft receiver such that when the motor assembly is added to the header system along the performed guide, the motor drive shaft engages the drive shaft receiver;

wherein the shade operates by a motor of the motor assembly when the motor assembly is added to the header system; and wherein the first tilt cord loops over and frictionally engages the first tilt cord pulley and the second tilt cord loops over and frictionally engages the second tilt cord pulley such that when the spool shaft is rotated slats of the shade are tilted.

18. The apparatus of claim 17 wherein the spool shaft is initially rotated slats of the shade are tilted; wherein once the slats are fully tilted, the first tilt cord pulley spins within the first tilt cord and the second tilt cord pulley spins within the second tilt cord as the at first cord spool and second cord spool raises or lowers the shade.

19. The appartus of claim 17 wherein the motor assembly includes a motor, a control board, and an encoder wherein the encoder tracks the position of the shade relative to the header.

20. The apparatus of claim 17 further including an engagement element on the first tilt cord wherein the engagement element intermittently connects with the first tilt cord pulley to tilt the shade when the engagement engages the first tilt cord pulley.

* * * * *

UNITED STATES PATENT AND TRADEMARK OFFICE

CERTIFICATE OF CORRECTION

PATENT NO. : 8,939,190 B2
APPLICATION NO. : 12/931328
DATED : January 27, 2015
INVENTOR(S) : Willis Jay Mullet et al.

It is certified that error appears in the above-identified patent and that said Letters Patent is hereby corrected as shown below:

In the Claims

Column 16, line 14, after “connect” insert -- with -- and after “the” delete “said”;

Column 16, line 47, after “connected” insert -- with -- and after “the” delete “said”;

Column 16, line 52, after “tilt” insert -- cord --;

Column 16, line 55, after “cover” insert -- and --;

Column 17, line 33, change “said” to -- aid --;

Column 18, line 45, after “engagement” insert -- element --.

Signed and Sealed this
Twenty-eighth Day of April, 2015

Michelle K. Lee

Michelle K. Lee
*Director of the United States Patent and Trademark Office*